US009303638B2

(12) United States Patent
Fenny et al.

(10) Patent No.: US 9,303,638 B2
(45) Date of Patent: Apr. 5, 2016

(54) VARIABLE RADIAL FLUID DEVICES IN SERIES

(75) Inventors: Carlos A. Fenny, Arlington, TX (US); James E. Sobel, Haslet, TX (US)

(73) Assignee: Bell Helicopter Textron Inc., Fort Worth, TX (US)

( * ) Notice: Subject to any disclaimer, the term of this patent is extended or adjusted under 35 U.S.C. 154(b) by 326 days.

(21) Appl. No.: 13/532,077

(22) Filed: Jun. 25, 2012

(65) Prior Publication Data

US 2013/0343923 A1 Dec. 26, 2013

(51) Int. Cl.

| | |
|---|---|
| ***F04B 49/00*** | (2006.01) |
| ***F04B 1/107*** | (2006.01) |
| ***F04B 9/04*** | (2006.01) |
| ***F04B 19/02*** | (2006.01) |
| ***F04B 23/06*** | (2006.01) |

(52) U.S. Cl.

CPC ..... *F04B 49/005* (2013.01); *F04B 1/1077* (2013.01); *F04B 9/042* (2013.01); *F04B 19/02* (2013.01); *F04B 23/06* (2013.01)

(58) Field of Classification Search

CPC ..... F04B 1/07; F04B 1/1071; F04B 1/1077; F04B 1/322; F04B 1/066; F04B 49/005; F04B 49/042

USPC ..... 417/218, 221, 271, 273, 315; 91/482, 91/483, 478, 492

See application file for complete search history.

(56) References Cited

U.S. PATENT DOCUMENTS

| | | | | |
|---|---|---|---|---|
| 2,431,175 | A | 11/1947 | Hoffer | |
| 2,617,360 | A | 11/1952 | Barker | |
| 2,650,543 | A | 9/1953 | Pauget | |
| 3,123,013 | A * | 3/1964 | Ganahl | 91/483 |
| 3,187,681 | A | 6/1965 | Firth et al. | |
| 3,895,565 | A * | 7/1975 | Schottler | 91/492 |
| 4,132,154 | A | 1/1979 | Nishiba | |
| 4,185,540 | A * | 1/1980 | Nonnenmacher | F04B 49/08 417/221 |
| 4,202,252 | A | 5/1980 | Muller | |

(Continued)

FOREIGN PATENT DOCUMENTS

| | | |
|---|---|---|
| DE | 2406659 A1 | 8/1974 |
| DE | 102010030852 | 1/2012 |

(Continued)

OTHER PUBLICATIONS

Office Action in related Canadian Application No. 2,818,047, dated May 29, 2014, 2 pages.

(Continued)

*Primary Examiner* — Devon Kramer
*Assistant Examiner* — Kenneth J Hansen
(74) *Attorney, Agent, or Firm* — Bell Helicopter Textron Inc.

(57) ABSTRACT

According to one embodiment, a radial fluid device comprises a cylinder block, a first plurality of pistons, a second plurality of pistons, a first cam, a second cam, and a coupling device. Each of the first plurality of pistons are slidably received within a different one of a first plurality of radially extending cylinders. Each of the second plurality of pistons are slidably received within a different one of a second plurality of radially extending cylinders. The first cam is disposed about the first plurality of radially extending cylinders. The second cam is disposed about the second plurality of radially extending cylinders. The coupling device is operable to couple the cylinder block to a cylinder block of a second radial fluid device.

21 Claims, 33 Drawing Sheets

(56) References Cited

U.S. PATENT DOCUMENTS

| | | | | |
|---|---|---|---|---|
| 5,368,448 | A * | 11/1994 | Maruno et al. | 417/221 |
| 6,099,281 | A | 8/2000 | Sobel | |
| 8,128,386 | B2 | 3/2012 | Veilleux, Jr. | |
| 2004/0065192 | A1 * | 4/2004 | Akasaka et al. | 91/491 |
| 2006/0222512 | A1 | 10/2006 | Hansen | |
| 2008/0060513 | A1 | 3/2008 | Miller et al. | |
| 2009/0060765 | A1 * | 3/2009 | Kuwabara et al. | 417/462 |
| 2011/0220230 | A1 | 9/2011 | Laird et al. | |
| 2011/0268596 | A1 | 11/2011 | Hansen et al. | |

FOREIGN PATENT DOCUMENTS

| | | | |
|---|---|---|---|
| FR | 2368619 | 5/1978 | |
| GB | 973036 | 10/1964 | |
| WO | 92/00455 | 1/1992 | |
| WO | WO 9200455 A1 * | 1/1992 | F01B 13/06 |

OTHER PUBLICATIONS

Office Action in related Canadian Application No. 2,818,778, dated May 30, 2014, 2 pages.
Office Action in related Canadian Application No. 2,818,634, dated Jun. 12, 2014, 2 pages.
European Search Report in related European Application No. 12186647.9, dated May 21, 2013, 6 pages.
European Search Report in related European Application No. 12186641.2, dated May 21, 2013, 6 pages.
European Search Report in related European Application No. 12186635.4, dated Dec. 21, 2012, 9 pages.
Moog-Pumps-RKP-II-SF-Catalog, Rev. 3.1, dated May 2010, 60 pages.
Final Office Action in related U.S. Appl. No. 13/532,044 dated 29 Dec. 29, 2014, 15 pages.
Final Office Action in related U.S. Appl. No. 13/532,015 dated Dec. 29, 2014, 13 pages.
Notice of Allowance in related Canadian Application No. 2,818,778 dated Mar. 6, 2015, 1 pages.
Advisory Action in related U.S. Appl. No. 13/532,015 dated Mar. 18, 2015, 3 pages.
Advisory Action in related U.S. Appl. No. 13/532,044 dated Mar. 19, 2015, 3 pages.
Office Action in related U.S. Appl. No. 13/532,015, dated Apr. 24, 2015, 16 pages.
Office Action in related U.S. Appl. No. 13/532,044, dated May 5, 2015, 21 pages.
Office Action in related Chinese Application No. 201310256225.9, dated May 19, 2015, 12 pages.
Office Action in related Chinese Application No. 201310256209.X, dated Apr. 3, 2015, 12 pages.
Office Action in related Chinese Application No. 201310257521.0, dated Apr. 3, 2015, 13 pages.
Office Action in related European Application No. 12 186 635.4, dated Aug. 5, 2015, 4 pages.

* cited by examiner

VARIABLE RADIAL FLUID DEVICES IN SERIES

TECHNICAL FIELD

This invention relates generally to radial fluid devices, and more particularly, to variable radial fluid devices in series.

BACKGROUND

The subject matter discussed in the background section herein should not be assumed to be prior art merely as a result of its mention in the background section. Similarly, a problem mentioned in the background section or associated with the subject matter of the background section should not be assumed to have been previously recognized in the prior art. The background section may rely on hindsight understanding and may describe subject matter in a manner not previously recognized in the prior art, and it should not be assumed that such descriptions represent the understanding or motivations of those skilled in the art before the filing of this application. The subject matter in the background section merely represents different approaches, which in and of themselves may also be inventions.

A fluid device may include any device that moves fluids or uses moving fluids. Two examples of a fluid device include a pump and a motor. A pump is a device that moves fluids (e.g., liquids, gases, slurries) using mechanical action. A motor is a device that converts energy received from fluids into mechanical action.

Pumps and motors may both use pistons to control fluid movement. A piston is a reciprocating component that allows fluid to expand in a chamber during an up stroke and compresses and/or ejects the fluid during a down stroke. In a pump, force may be transferred from the crankshaft to the piston for purposes of compressing or ejecting the fluid. In a motor, force may be transferred from the fluid to the piston for purposes of rotating the crankshaft. In some fluid devices, a piston may also act as a valve by covering and uncovering ports in a chamber wall.

In one example, a piston is a cylindrical component that utilizes a close tolerance cylindrical fit between the piston and a cylinder bore chamber to minimize efficiency loses from internal leakage. The term "cylinder" and its variants may refer to a general cylindrical shape represented by points at a fixed distance from a given line segment, although in practice cylinders may not be perfectly cylindrical (e.g., due to manufacturing constraints) and may include non-cylindrical cavities, passageways, and other areas.

Some fluid devices may be classified as fixed displacement or variable displacement. In a fixed-displacement fluid device, displacement distance of each piston stroke remains constant, and fluid flow through the fluid device per rotation cannot be adjusted. In a variable displacement fluid device, fluid flow through the fluid device per rotation may be adjusted by varying the displacement distance of each piston stroke.

In some fluid devices, pistons are arranged axially such that their piston stroke centerlines are configured in a circle parallel to the rotational axis of the cylinder block centerline. FIG. 1 shows a cross-section of an example axial fluid device 100. Axial fluid device 100 features a shaft 110, a cylinder block 120, a swashplate 130, pistons 140, and a pressure compensator 150. Pistons 110 may reciprocate within cylinders of cylinder block 120. Swashplate 130 allows energy to be converted between the rotary motion of shaft 110 and the linear motion of pistons 140. Swashplate 130 drives each piston 110 through one sinusoidal stroke motion for each revolution of shaft 110. A sinusoidal stroke includes one "up stroke" motion and one "down stroke" motion.

In a fixed-displacement fluid device, the angle of swashplate 130 is fixed. In a variable-displacement fluid device, pressure compensator 150 may vary the angle of swashplate 130 to change displacement and direction. To minimize the load required to change the angle of swashplate 130 in variable-displacement fluid devices, the diameters of pistons 110 may be kept small, and the pivot axis of swashplate 130 may be offset from the rotation axis of cylinder block 120 to allow forces from pistons 110 to counterbalance the load.

In other fluid devices, pistons are arranged radially such that their piston stroke centerlines are configured radially outward from the rotation axis of the cylinder block. FIGS. 2A and 2B show cross-sections of an example radial fluid device 200. Radial fluid device 200 features a shaft 210, a cylinder block 220, a cam 230, pistons 240, and pressure compensator 250. In this example, pressure compensator 250 may vary the displacement and direction of pistons 240 by varying the offset of the centerline of cam 230 relative to the centerline of cylinder block 220. The load required to move cam 230 is relatively high because the configuration has a high piston diameter to stroke ratio compared to axial designs and there are no forces available to counterbalance the piston loads acting on the cam. Thus, pressure compensator 250 must be large enough to provide the force necessary to move cam 230.

In the example of radial fluid device 200, cam 230 is circular. In this example, circular cam 230 may be referred to as a single-lobed cam because it causes pistons 240 to complete only one sinusoidal stroke per rotation of cylinder block 220. Cams having more than one lobe, such as an elliptical (two-lobed) cam, do not typically lend themselves to being offset to vary displacement because of their unique shape.

In the example of FIG. 2, radial fluid device 200 varies fluid flow by varying piston stroke displacement. As explained above, such an arrangement requires a significant amount of force to move cam 230. In an alternative approach, fluid flow may be varied by varying valve timing. For example, U.S. Patent Publication No. 2011/0220230 describes a radial pump with fixed piston displacement and independent electronic intake valve control. Varying valve timing may require more energy to open and close each valve, however. In particular, varying valve timing may require closing the inlet valve and opening the outlet valve at points in the piston stroke where hydraulic flow is at a maximum.

SUMMARY

Particular embodiments of the present disclosure may provide one or more technical advantages. A technical advantage of one embodiment may include the capability to fully reverse fluid flow in a fluid device. A technical advantage of one embodiment may include the capability to adjust fluid flow through a fluid device without varying the displacement distance of each piston. A technical advantage of one embodiment may also include the capability to adjust fluid flow with a minimal amount of force. A technical advantage of one embodiment may also include the capability to effectively lower the volume within a fluid chamber by varying when pistons in the chamber begin their stroke. A technical advantage of one embodiment may also include the capability to increase shaft speed by balancing piston forces. A technical advantage of one embodiment may also include reduced vibration and hydraulic pressure pulse levels. A technical advantage of one embodiment may also include the capability to connect multiple fluid devices along a common drive shaft.

Certain embodiments of the present disclosure may include some, all, or none of the above advantages. One or more other technical advantages may be readily apparent to those skilled in the art from the figures, descriptions, and claims included herein.

BRIEF DESCRIPTION OF THE DRAWINGS

To provide a more complete understanding of the present invention and the features and advantages thereof, reference is made to the following description taken in conjunction with the accompanying drawings, in which.

DETAILED DESCRIPTION OF THE DRAWINGS

As explained above, fluid flow may be varied in a fluid device by varying piston stroke displacement distance or varying valve timing. Varying piston stroke displacement distance, however, may require a substantial amount of energy to move the cam in order to vary displacement distance. Likewise, varying valve timing may require a substantial amount of energy to open and close valves when hydraulic flow is at a maximum.

Teachings of certain embodiments recognize the capability to adjust fluid flow in a fluid device without varying piston stroke displacement distance or varying valve timing. Teachings of certain embodiments also recognize the capability to adjust fluid flow using a minimal amount of energy as compared to varying piston stroke displacement distance or varying valve timing.

Figure 1:
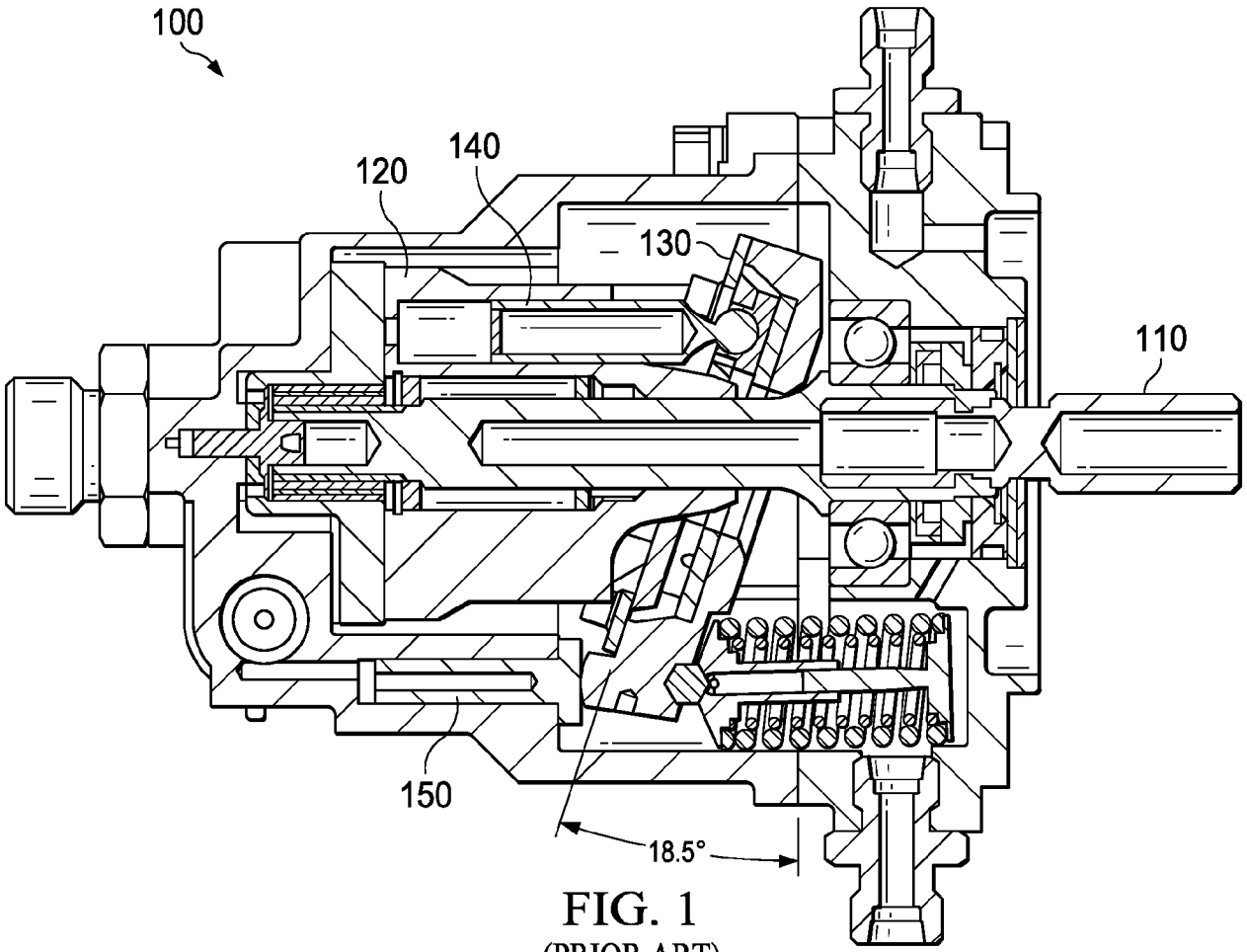
FIG. 1 (PRIOR ART)
FIG. 1 shows a cross-section of a prior art axial fluid device.
Figure 2A:
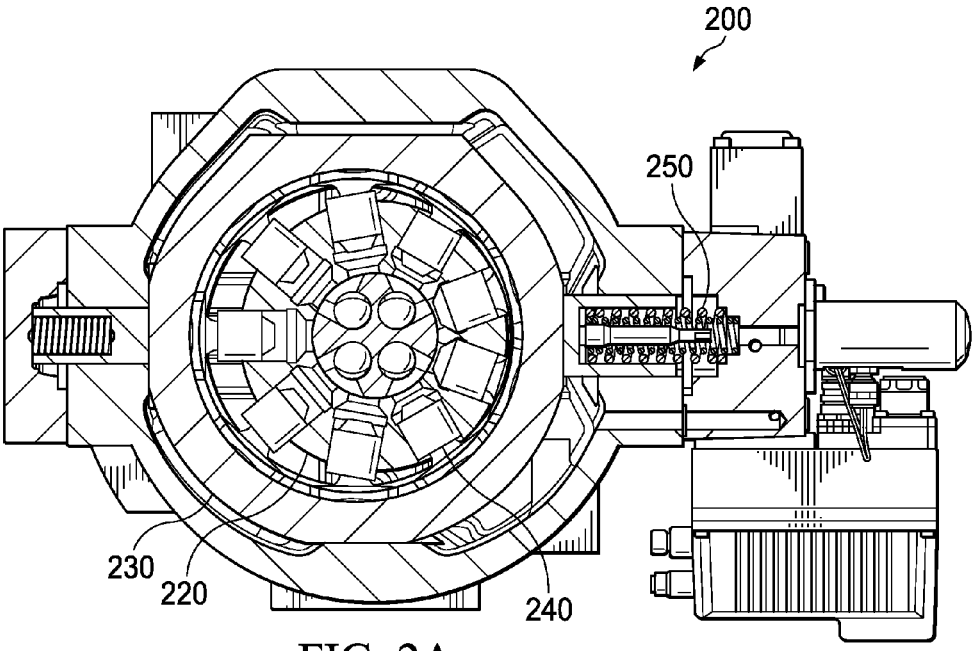
FIG. 2A (PRIOR ART)
FIG. 2 shows a cross-section of a prior art radial fluid device.
Figure 2B:
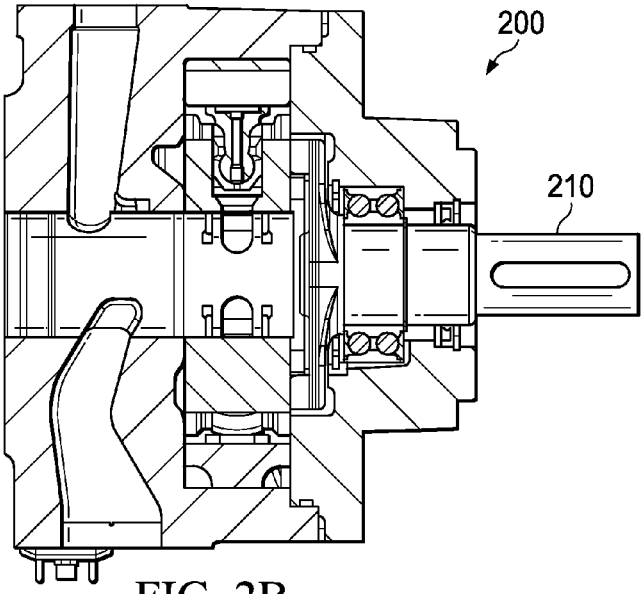
FIG. 2B (PRIOR ART)
Figure 3B:
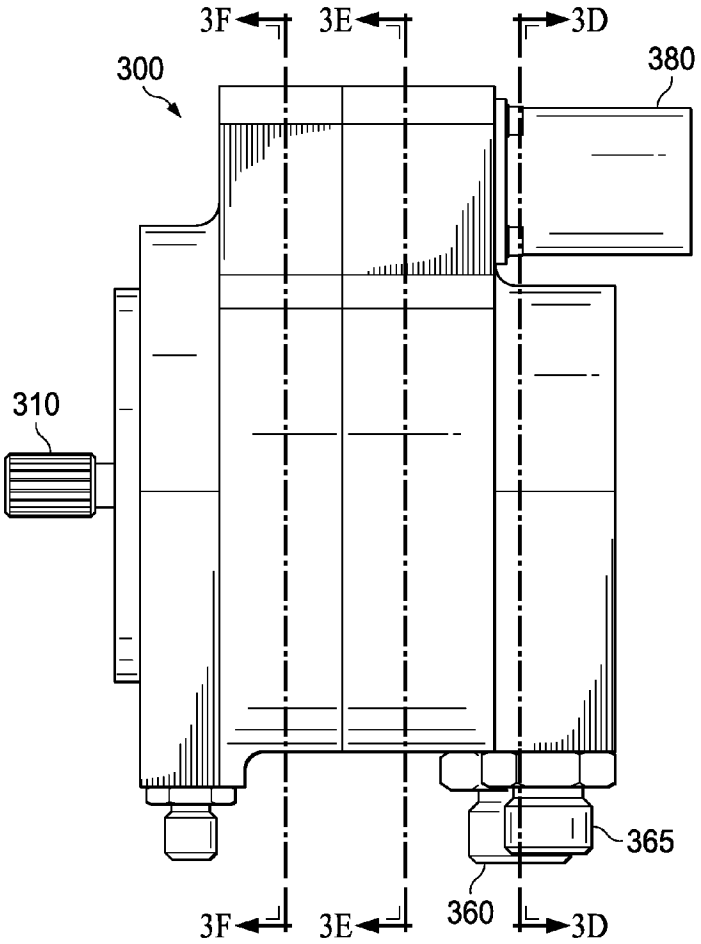
FIGS. 3A-3F show a radial fluid device according to one example embodiment.
Figure 3A:
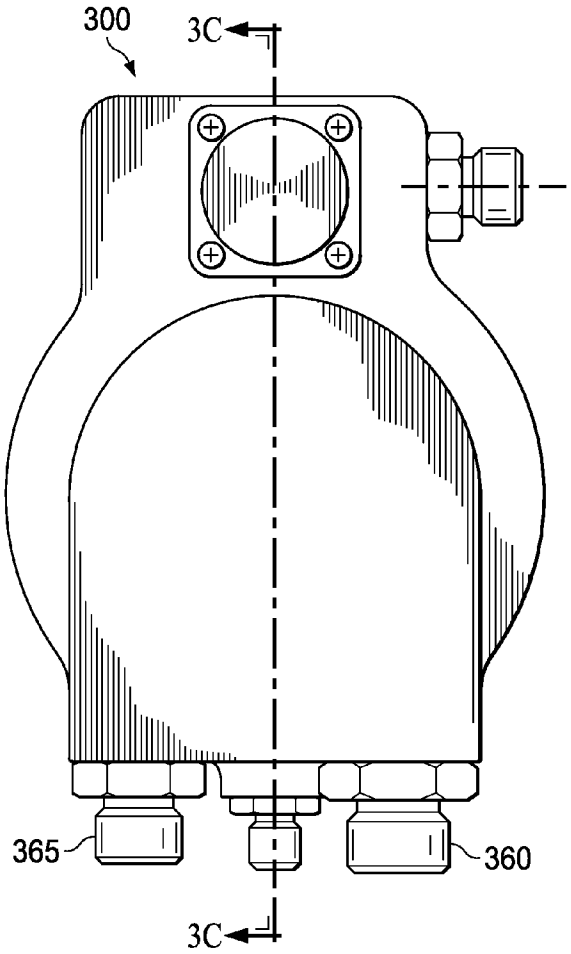
Figure 3D:
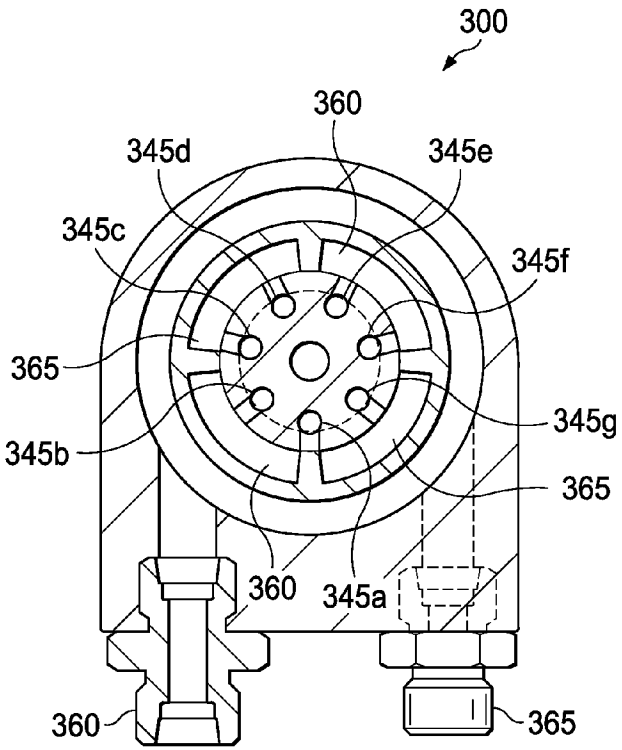
Figure 3C:
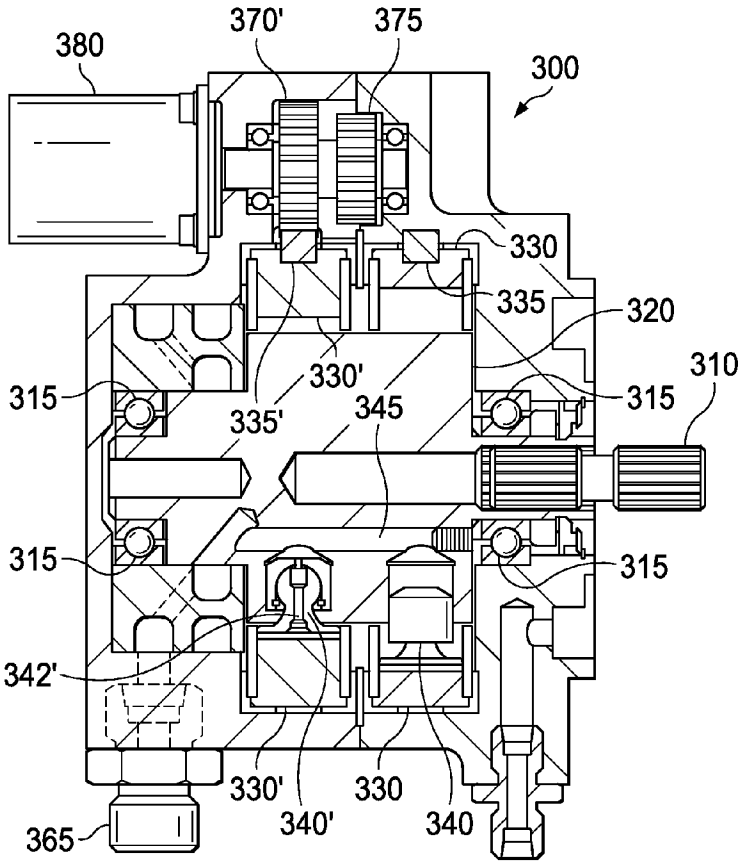

FIGS. 3A-3F show a radial fluid device 300 according to one example embodiment. FIG. 3A shows a front view of radial fluid device 300, and FIG. 3B shows a side view of radial fluid device 300. FIG. 3C shows a cross-section view of radial fluid device 300 along the cross-section line indicated in FIG. 3A, and FIGS. 3D, 3E, and 3F show cross-section views of radial fluid device 300 along the cross-section lines indicated in FIG. 3B.

As seen in FIGS. 3A-3F, radial fluid device 300 features a shaft 310, bearings 315, a cylinder block 320, cams 330 and 330', cam gears 335 and 335', pistons 340*a*-340*f*, pistons 340*a*'-340*f*', piston chambers 345*a*-345*f*, ports 360 and 365, drive gears 370 and 370', reverse rotation gear 375, and cam adjuster 380.

Shaft 310 is coupled to cylinder block 320. In some embodiments, shaft 310 is removably coupled to cylinder block 320. For example, different shafts 310 may have different gear splines, and an installer may choose from among different shafts 310 for use with radial fluid device 300. If radial fluid device 300 is operating as a pump, for example, the installer may choose a shaft 310 splined to match a driving motor to be coupled to shaft 310 opposite cylinder 320.

Cylinder block 320 rotates within radial fluid device 300. In the example of FIGS. 3A-3F, the axis of rotation of cylinder block 320 is coaxial with shaft 310. Bearings 315 separate cylinder block 320 from the non-rotating body of radial fluid device 300.

Cylinder block 320 includes a plurality of cylinders for receiving pistons 340*a*-340*g* and pistons 340*a*'-340*g*'. Each piston 340*a*-340*g* and 340*a*'-340*g*' may include a radially extending aperture, such as aperture 342' shown in FIG. 3C. Each piston 340*a*-340*g* and 340*a*'-340*g*' may also include a shoe, such as shoes 341*a*-341*g* and 341*a*'-341*g*' in FIGS. 3E and 3F. In the example of FIGS. 3A-3F, cylinder block 320 includes a first group of seven radially-extending cylinders and a second group of seven radially-extending cylinders adjacent to the first group. Each radially-extending cylinder of the first group is in fluid communication with one radially-extending cylinder of the second group to form a piston chamber 345. Each piston chamber 345 thus includes two cylinders, each configured to receive a piston 340 or piston 340'. Each piston chamber 345 also includes cavities connecting the two chambers to each other as well to outside of cylinder block 320 such that each piston chamber 345 may receive fluid from and/or discharge fluid into ports 360 and 365, as seen in FIG. 3D.

Figure 3F:
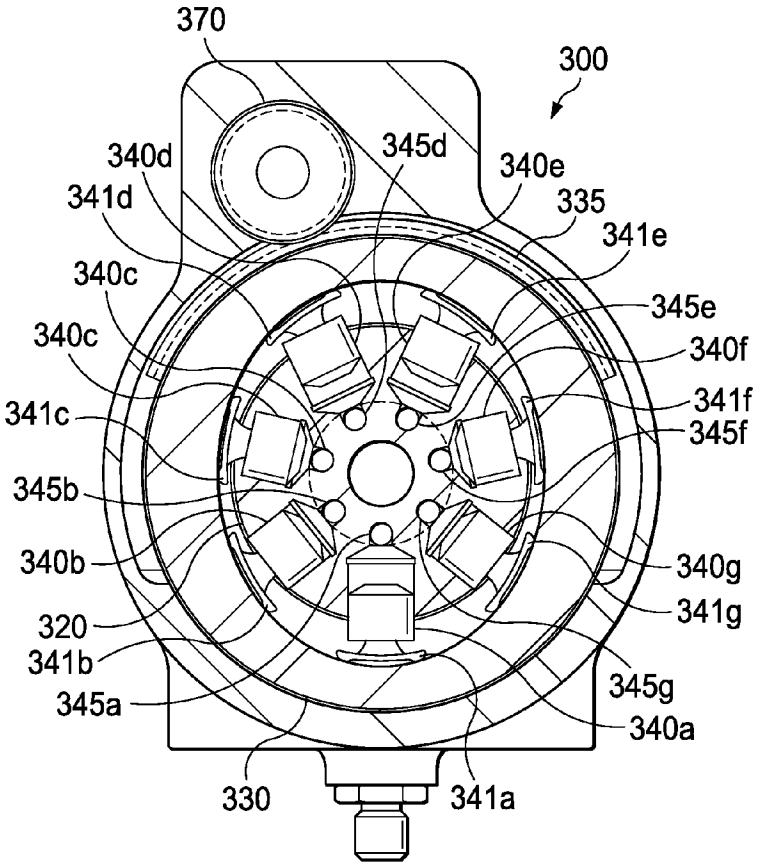

The example of FIGS. 3A-3F includes seven piston chambers 345*a*-345*f*. Each chamber 345 is configured to receive one piston 340 and one piston 340'. For example, piston chamber 345*a* includes two cylinders configured to receive pistons 340*a* and 340*a*', respectively; piston chamber 345*b* includes two cylinders configured to receive pistons 340*b* and 340*b*', respectively; piston chamber 345*c* includes two cylinders configured to receive pistons 340*c* and 340*c*', respectively; piston chamber 345*d* includes two cylinders configured to receive pistons 340*d* and 340*d*', respectively; piston chamber 345*e* includes two cylinders configured to receive pistons 340*e* and 340*e*', respectively; and piston chamber 345*f* includes two cylinders configured to receive pistons 340*f* and 340*f*', respectively. Cam 330 is disposed about pistons 340, and cam 330' is disposed about pistons 340'. During operation, pistons 340 and 340' stroke inwards and outwards depending on the distance between cam 330 and the axis of rotation of cylinder block 320 and the distance between cam 330' and the axis of rotation of cylinder block 320. For example, cam 330 in FIG. 3F is an elliptical cam having two lobes. As each piston 340 moves from the transverse diameter of cam 330 towards the conjugate diameter of cam 330, the piston 340 will be pushed closer to the axis of rotation of cylinder block 320. Likewise, as each piston 340 moves from the conjugate diameter of cam 330 to the transverse diameter of cam 330, the piston 340 will be pushed away from the axis of rotation of cylinder block 320. As a result, each piston 340 reciprocates towards and away from the axis of rotation of cylinder block 320. Each reciprocation towards and away from the axis of rotation thus includes two strokes: a down stroke and an up stroke.

Rotating cams 330 and 330' may change when pistons 340 and 340' begin their strokes. For example, rotating cam 330 changes the location of the transverse diameter of cam 330 and thus changes where piston 340*a* begins a down stroke. Similarly, rotating cam 330' changes the location of the transverse diameter of cam 330' and thus changes where piston 340*a*' begins a down stroke. Thus, moving cam 330 and/or cam 330' relative to one another changes the amount of time between when cam 330 and cam 330' begin their downstrokes. Teachings of certain embodiments recognize that changing the amount of time between the downstrokes of cams 340*a* and 340*a*' may change the maximum accessible cylinder volume of chamber 345*a* and therefore change how fluid flows in and out of radial fluid device 300.

Figure 3E:
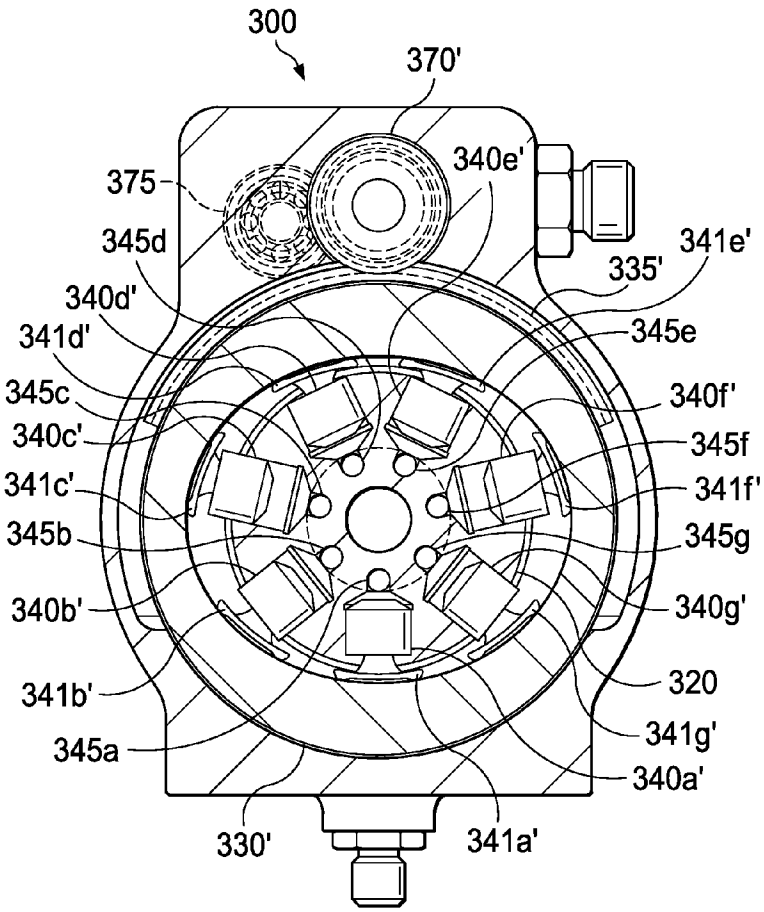

In the example of FIGS. 3E and 3F, cams 330 and 330' are elliptical and thus have two lobes. The number of lobes indicates how many sinusoidal stroke motions a piston completes during one full rotation of cylinder block 320. For example, each piston 340 and 340' completes two sinusoidal stroke motions during one rotation of cylinder block 320. Teachings of certain embodiments recognize that multi-lobe cams may allow for additional power generation over single-lobe cams. Due to the unusual shape of multi-lobe cams, however, they do not typically lend themselves to variable-displacement designs. Teachings of certain embodiments, however, recognize the capability to vary fluid flow in fluid devices that utilize multi-lobe cams. Ports 360 and 365 provide fluid into and out of radial fluid device 300. Ports 360 and 365 may each operate as either an inlet or an exhaust. Teachings of certain embodiments recognize the capability to reverse the flow within radial fluid device 300. Reversing the flow may convert a port from an inlet to an exhaust or from an exhaust to an inlet. Flow reversing will be described in greater detail with regard to FIGS. 4A-4K.

Cam gears 335 and 335', drive gears 370 and 370, reverse rotation gear 375, and cam adjuster 380 in combination adjust the position of cams 330 and 330'. Cam gears 335 and 335' are coupled to cams 330 and 330', respectively. Drive gears 370 and 370' interact with the teeth of cam gears 335 and 335'. Reverse drive gear 375 interacts with drive gears 370 and/or 370', either directly or indirectly. In particular, reverse drive gear 375 mechanically couples drive gears 370 and 370' together such that rotation in one direction by drive gear 370 results in rotation in the opposite direction by drive gear 370'. Cam adjuster 380 rotates at least one of drive gear 370, drive gear 370', and reverse rotation gear 375 such that drive gear 370 and drive gear 370' rotates cam gears 33 and 335'.

As stated above, moving cams 330 and 330' changes when pistons 340 and 340' begin their strokes, and changing when pistons 340 and 340' begin their strokes can change how fluid flows in and out of radial fluid device 300. Teachings of certain embodiments recognize that mechanically coupling cam 330 to cam 330' may reduce the energy needed to vary fluid flow through radial fluid device 300 by reducing the energy needed to rotate cams 330 and 330'.

In particular, cams 330 and 330' are mechanically linked such that rotation in one direction by cam 330 results in rotation in the opposite direction by cam 330'. When cylinder block 320 is rotating, one of cams 330 and 330' may move in the same direction of cylinder block 320, and the other cam may move in the opposite direction of cylinder block 320. If cams 330 and 330' were not linked, inertial and other forces could make rotating a cam with the direction of rotating of cylinder block 320 extremely easy but rotating a cam against the direction of rotating of cylinder block 320 extremely difficult. By mechanically linking cam 330 to cam 330', however, the overall energy required to move both cams is reduced. Mechanically linking cam 330 to cam 330' effectively cancels out the inertial forces acting on both cams. Thus, teachings of certain embodiments recognize that moving both cam 330 and cam 330' may require less force than moving one cam alone against the rotation of cylinder block 320.

In some embodiments, cams 330 and 330' are mechanically linked to rotate in equal distances as well as rotate in opposite directions. For example, ten degrees of separation may be created between cams 330 and 330' by rotating each cam five degrees in either direction.

As explained above, rotating cams 330 and 330' may change how fluid flows through radial fluid device 300. In particular, rotating cams 330 and 330' may change when pistons 340 and 340' begin their strokes, and changing when pistons 340 and 340' begin their strokes may change the maximum accessible cylinder volume within each piston chamber 345. Changing the maximum accessible cylinder volume within each piston chamber 345 changes the volume of fluid flowing through radial fluid device 300.

FIGS. 4A-4K illustrate piston chamber volume charts 400*a*-400*k*, which show how maximum accessible cylinder volume changes as a function of cylinder block rotation and cam phase. Each piston chamber volume chart 400*a*-400*k* shows maximum accessible cylinder volume of a piston chamber as a function of cylinder block rotation for a particular cam phase. The bottom horizontal axis is marked in angular degrees to show the position of cylinder block 320 through a full revolution, and the top horizontal axis shows piston stroke relative to ports 360 and 365. The top horizontal axis also indicates whether ports 360 and 365 are operating as an inlet or an exhaust. The vertical axis shows the relative changes in maximum accessible cylinder volume in non-dimensional terms. The top half of each piston chamber volume chart 400*a*-400*k* shows the sum volume of two pistons along with a diagram showing the relationship of the rotary valve flow direction to changes in the cam index positions. The bottom of each chart 400*a*-400*k* shows changes in cylinder volume for each piston in a chamber as cylinder block 320 rotates through a full revolution.

Figure 4A:
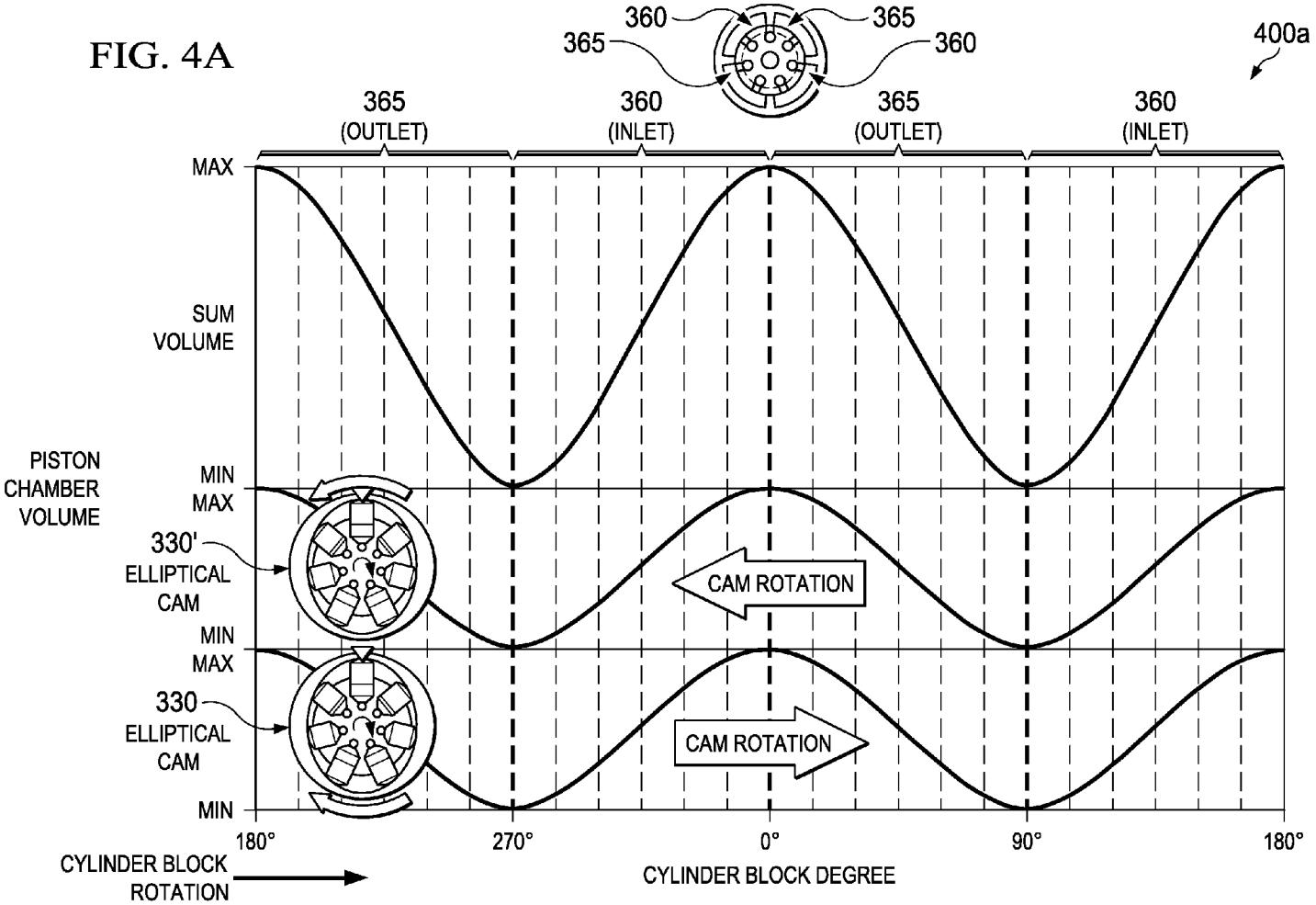
FIGS. 4A-4K illustrate piston chamber volume charts showing how maximum accessible cylinder volume of the radial fluid device of FIG. 3A-3F changes as a function of cylinder block rotation and cam phase.

In FIG. 4A, piston chamber volume chart 400*a* shows the delta angle between the bottom dead center (BDC) positions of two elliptical cams 330 and 330' is zero degrees, and the cams BDC positions are indexed at zero degrees relative to the rotary valve. With cams in this position, the sinusoidal volume changes of two pistons 340 and 340' are in phase, and their cylinder volumes fully summed create 100% maximum flow output. As the cylinder block rotates pistons 340 and 340' from zero degrees BCD to degrees top dead center (TDC), fluid enters piston chamber 345 through port 360. Then as cylinder block 320 rotates from 90 degrees to 180 degrees (the second BDC), fluid exits the piston chamber 345 through port 365. The same complete cycle is repeated a second time as cylinder block 320 rotates from 180 degrees to 360 degrees (back to zero degrees).

Figure 4B:
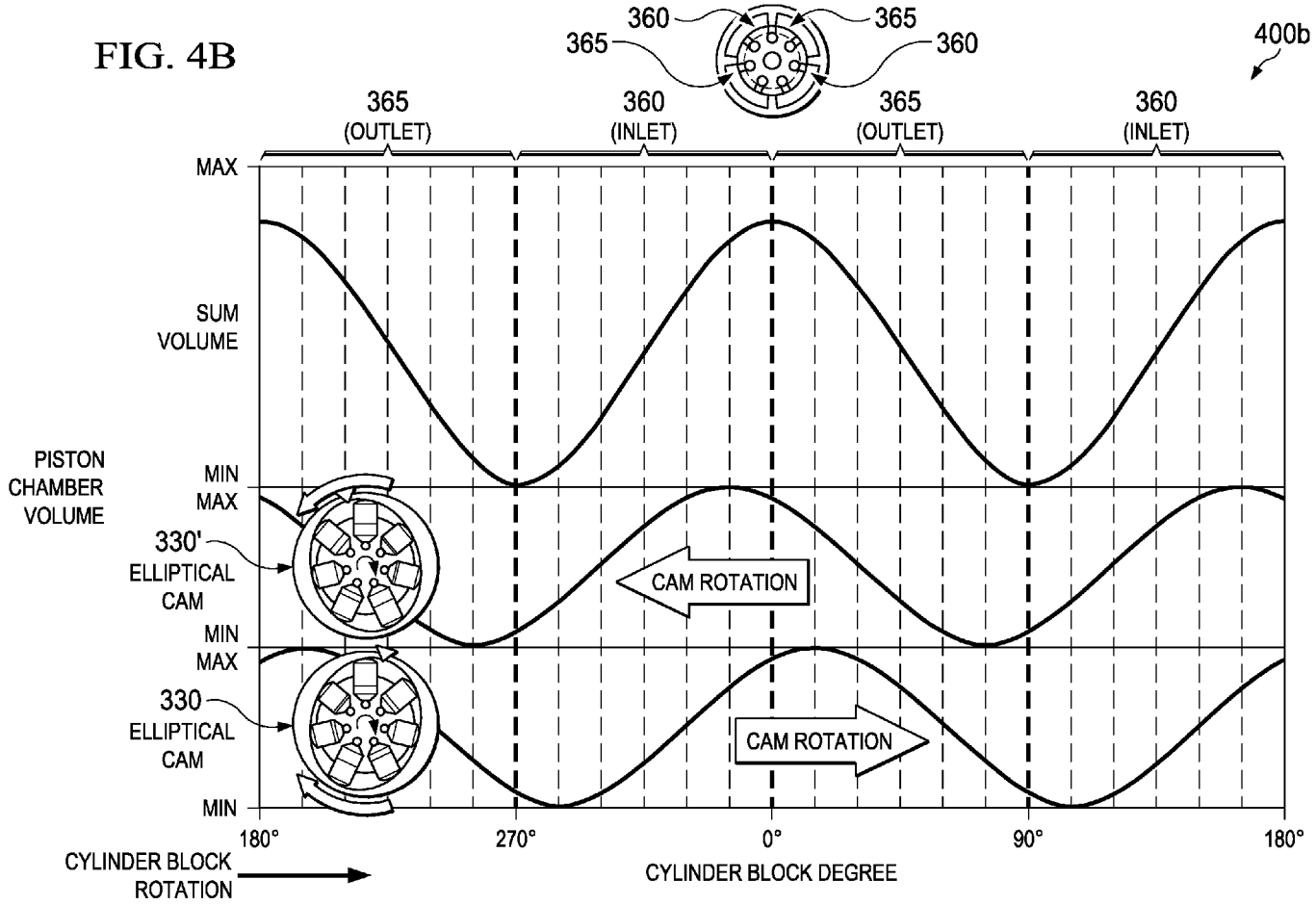

In FIG. 4B, piston chamber volume chart 400*b* shows the delta angle between the BDC positions of two elliptical cams is changed to 30 degrees by rotating cam 330 15 degrees clockwise and cam 330' 15 degrees counterclockwise. With cams 330 and 330' in this position, the effective sum of the maximum sinusoidal volume of both cylinders in chamber 345 is reduced to 83% of maximum flow output. Note that the effective change in cylinder volume does not affect the relationship between the rotary valve timing and the maximum and minimum sinusoidal volume peaks. Thus, flow is near zero as the rotary valve ports open and close, minimizing internal pump and external system pressure spikes. In addition, the decrease in pump operating efficiency resulting from pumping fluid between pistons should be negligible.

Figure 4C:
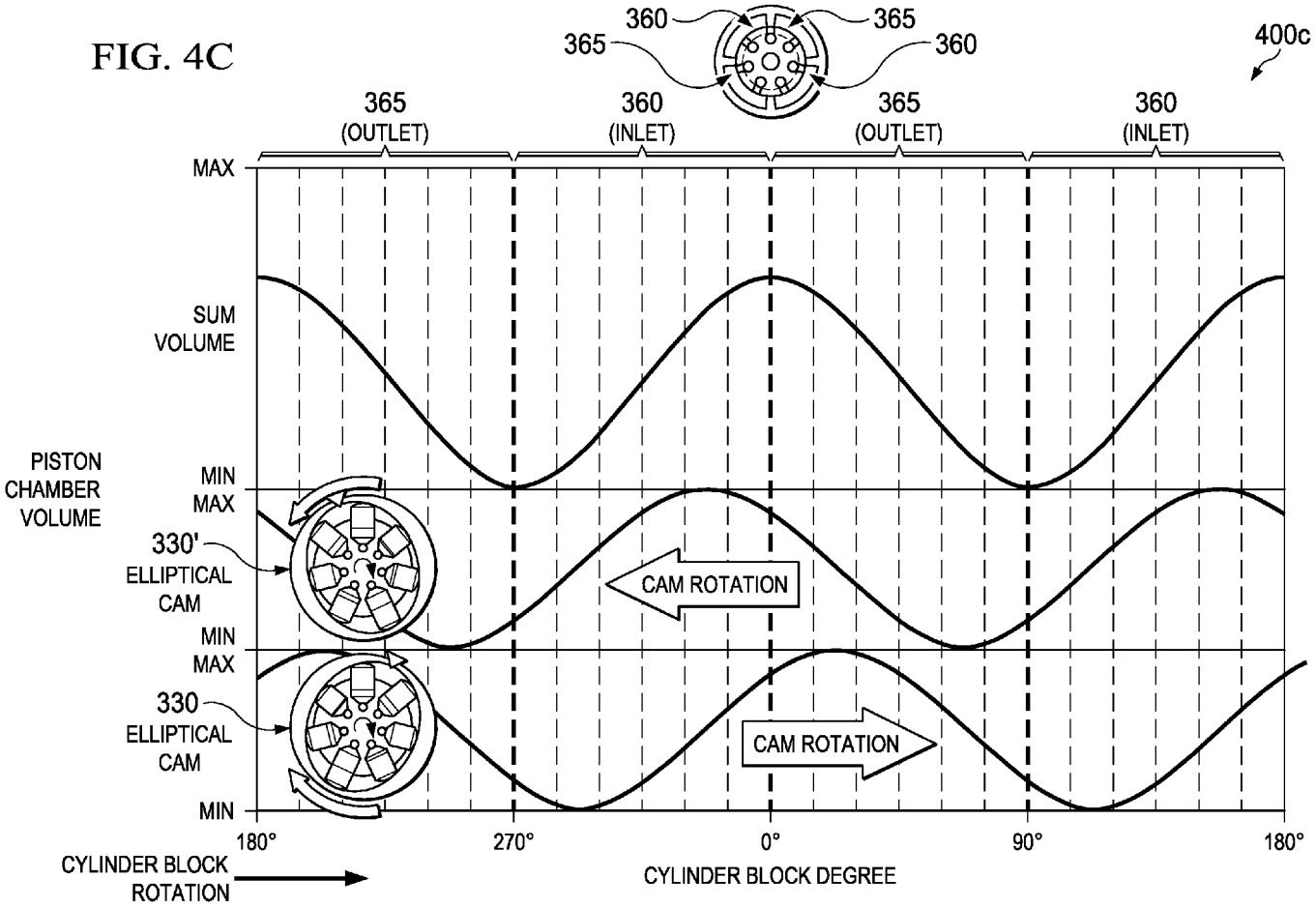
Figure 4D:
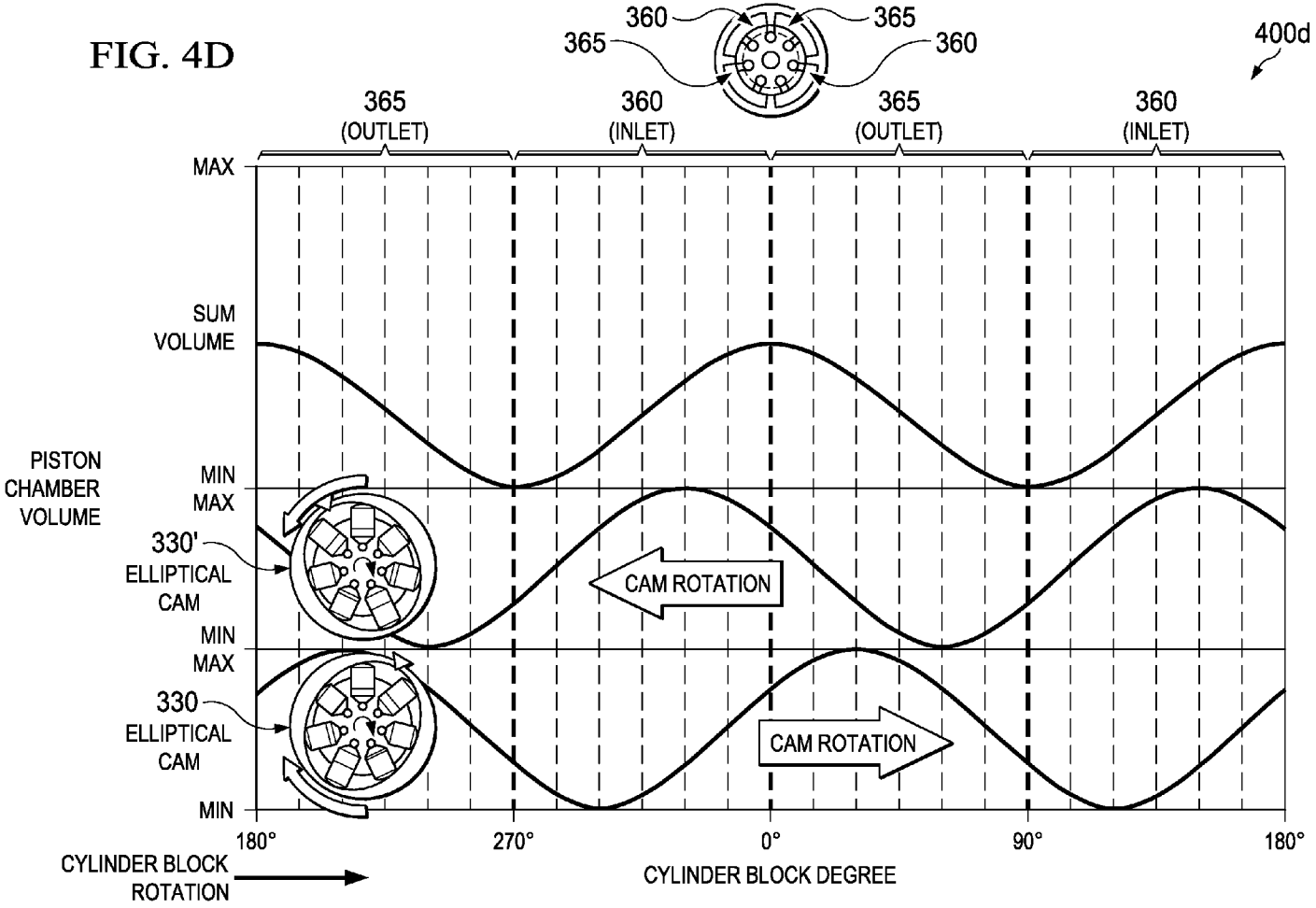
Figure 4E:
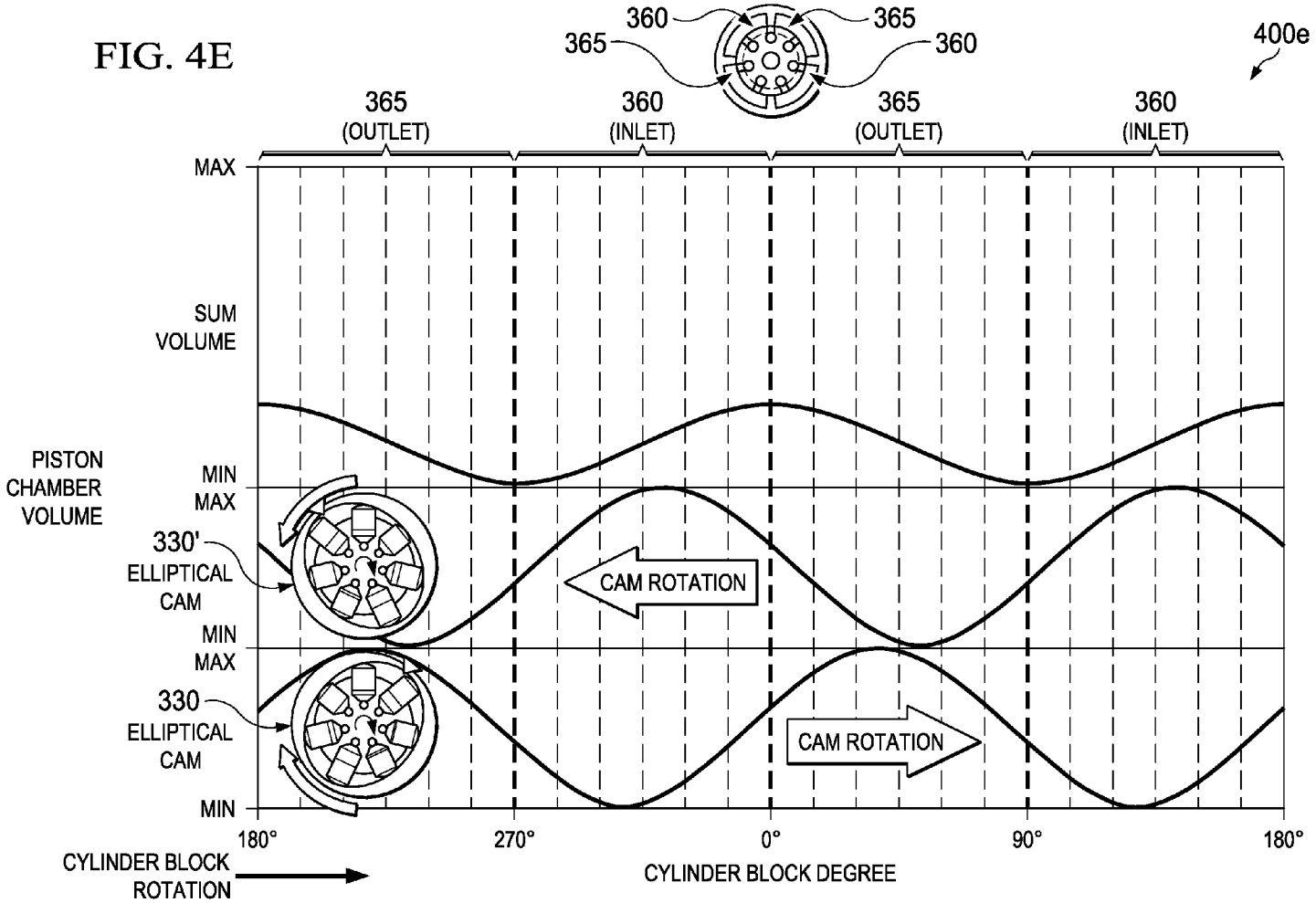

FIGS. 4C, 4D, and 4E progressively depict the effect of increasing the delta index angle between the BDC positions of cams 330 and 330' from 45 degrees, 60 degrees, and 75 degrees. As shown in piston chamber volume charts 400*c*-

400*e*, increasing the delta phase angle results in effective reductions in the sum of maximum sinusoidal cylinder volume to 66%, 44%, and 25% of maximum. Each change in delta index angle does not disrupt the relationship between rotary valve timing and the maximum and minimum sinusoidal volume peaks.

Figure 4F:
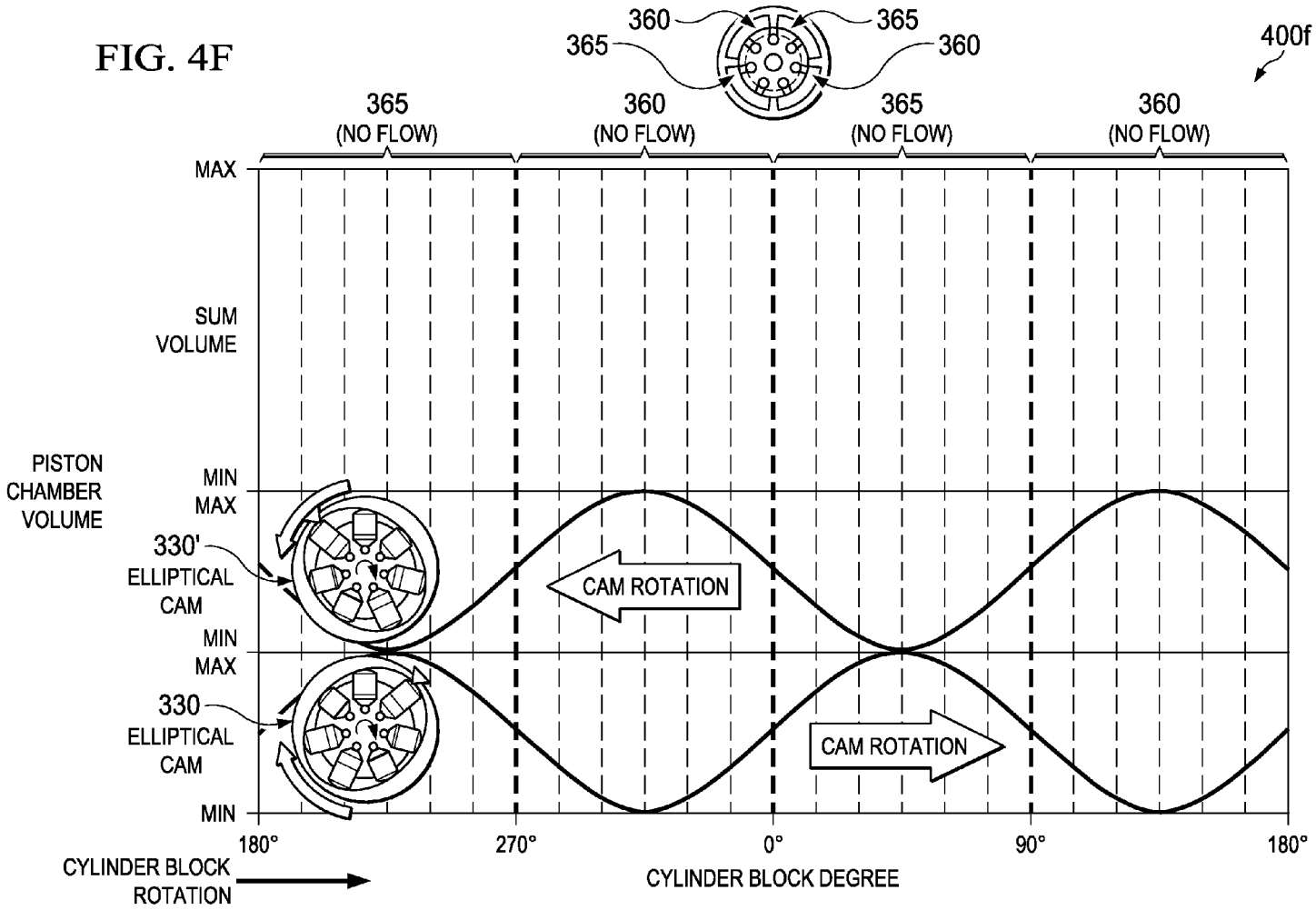

In FIG. 4F, piston chamber volume chart 400*f* shows the delta angle between the BDC positions of two elliptical cams 330 and 330' is 90 degrees. FIG. 4F shows cams 330 and 330' as they appear in FIGS. 3A-3F. As shown in piston chamber volume chart 400*f*, the delta angle between the BDC positions of two elliptical cams is changed to 90 degrees by rotating cam 330 45 degrees clockwise and cam 330' 45 degrees counterclockwise. With cams 330 and 330' in this position, the effective sum of the maximum sinusoidal volume of both cylinders in chamber 345 is reduced to 0% of maximum flow output. In this arrangement, fluid may pass from one cylinder to an adjacent cylinder as pistons 340 and 340' alternate strokes.

Figure 4G:
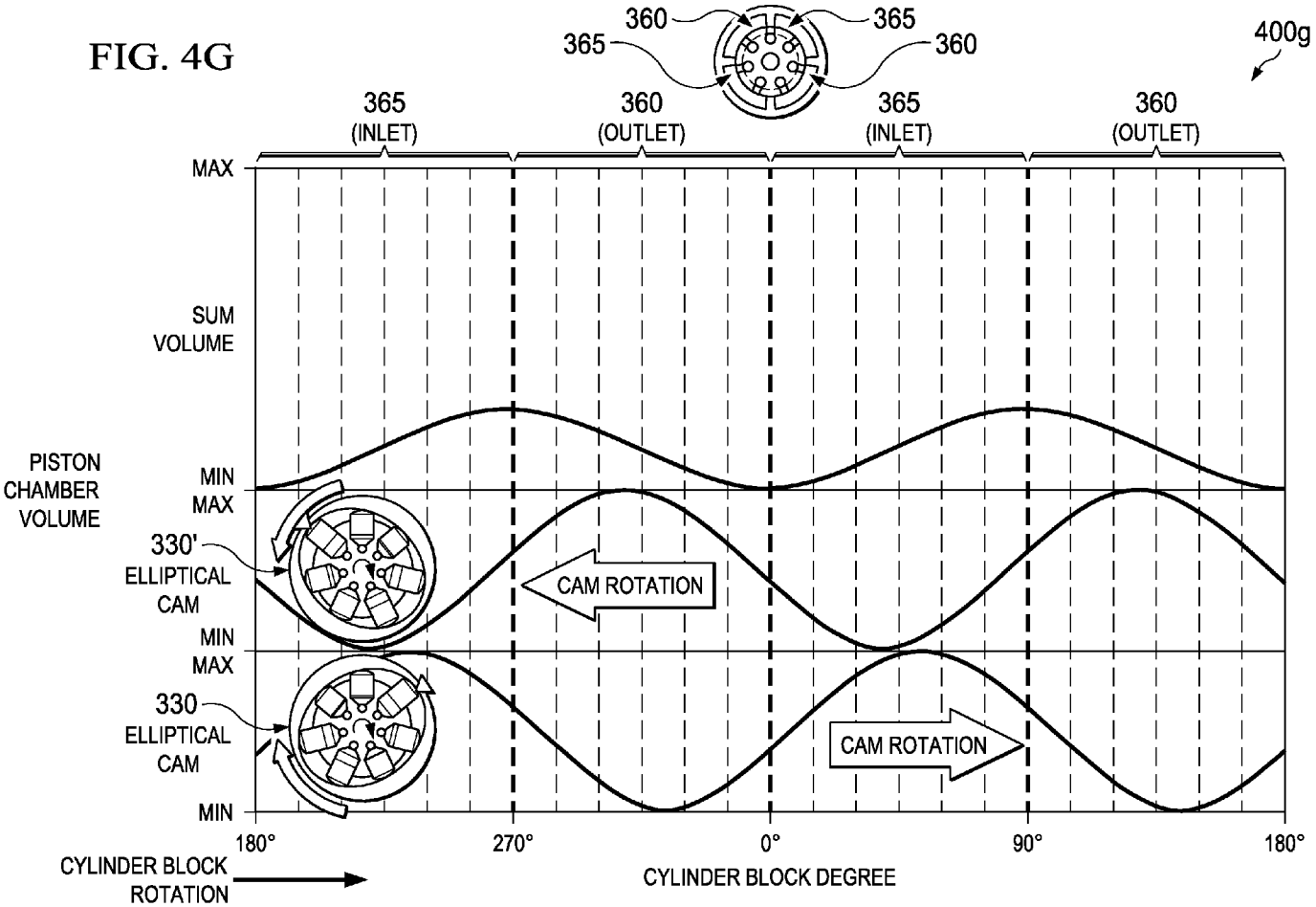
Figure 4H:
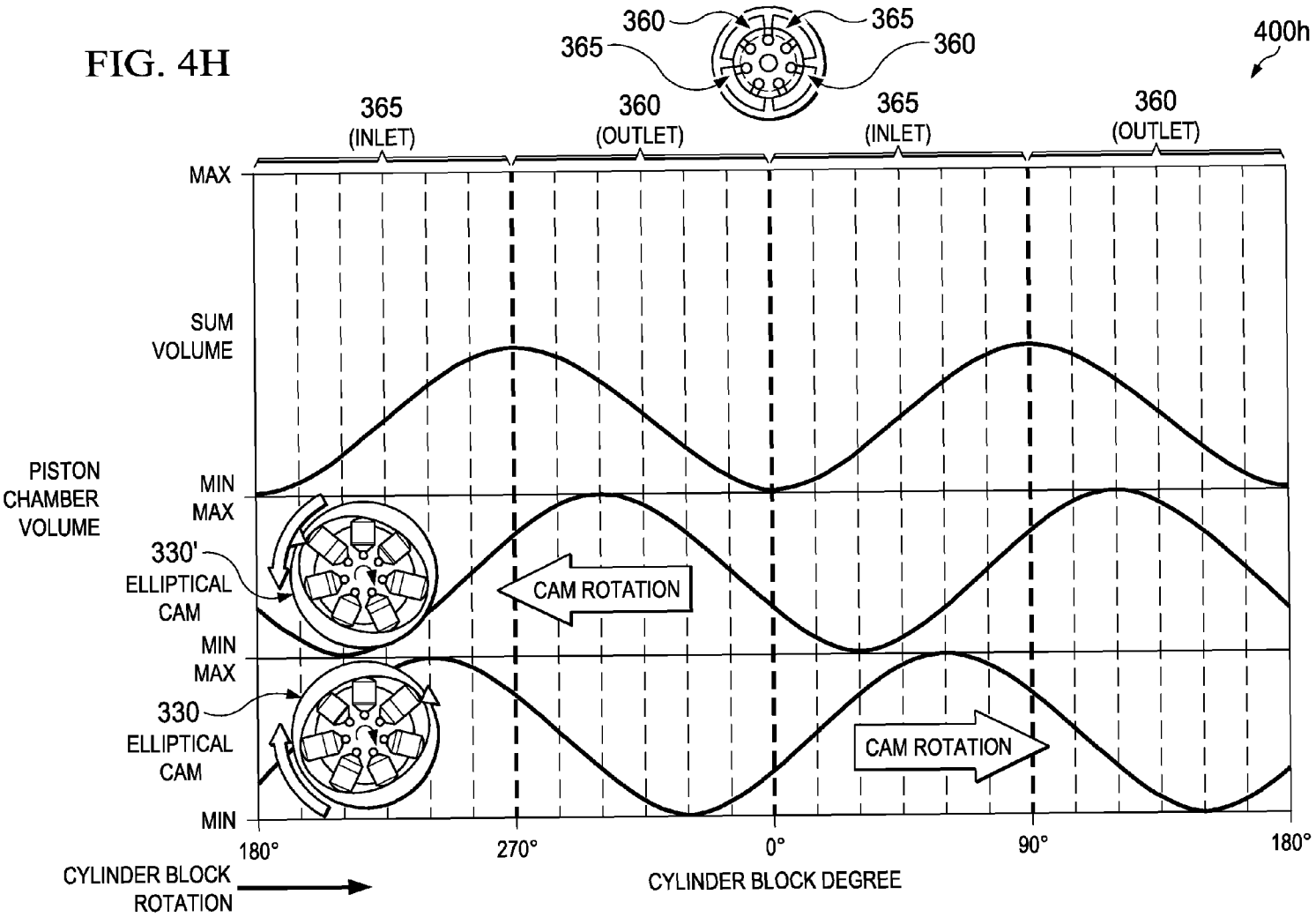
Figure 4I:
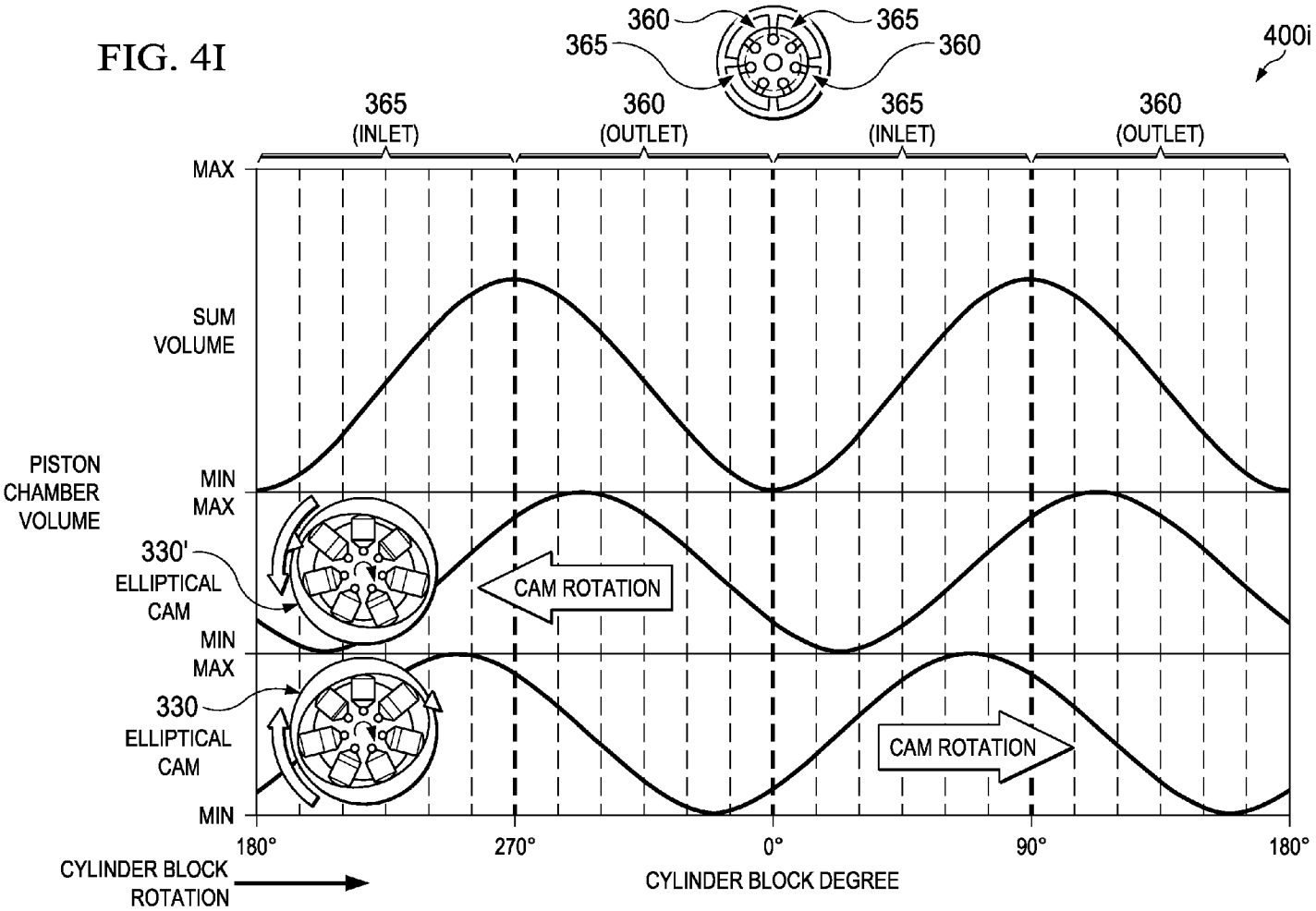
Figure 4J:
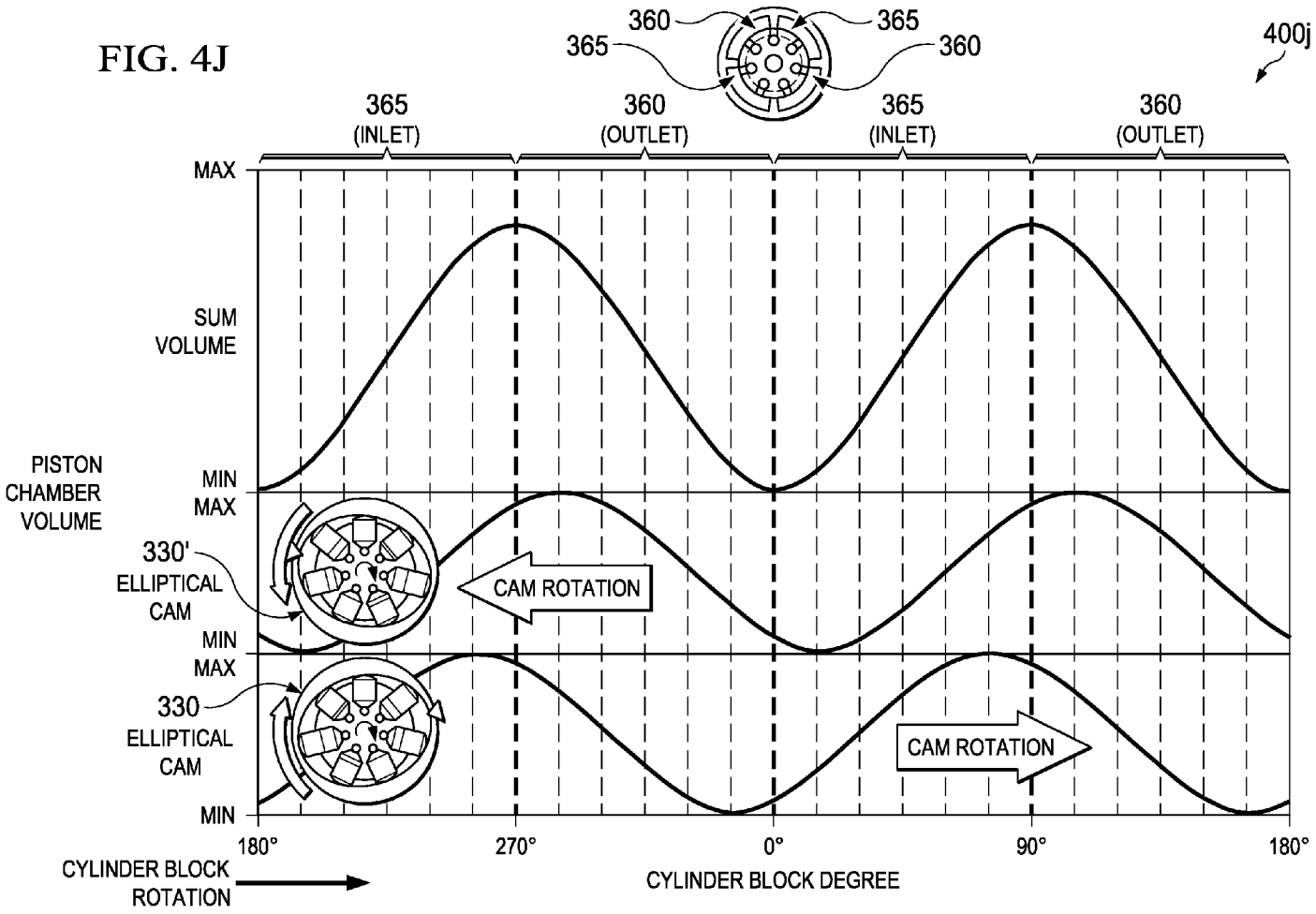
Figure 4K:
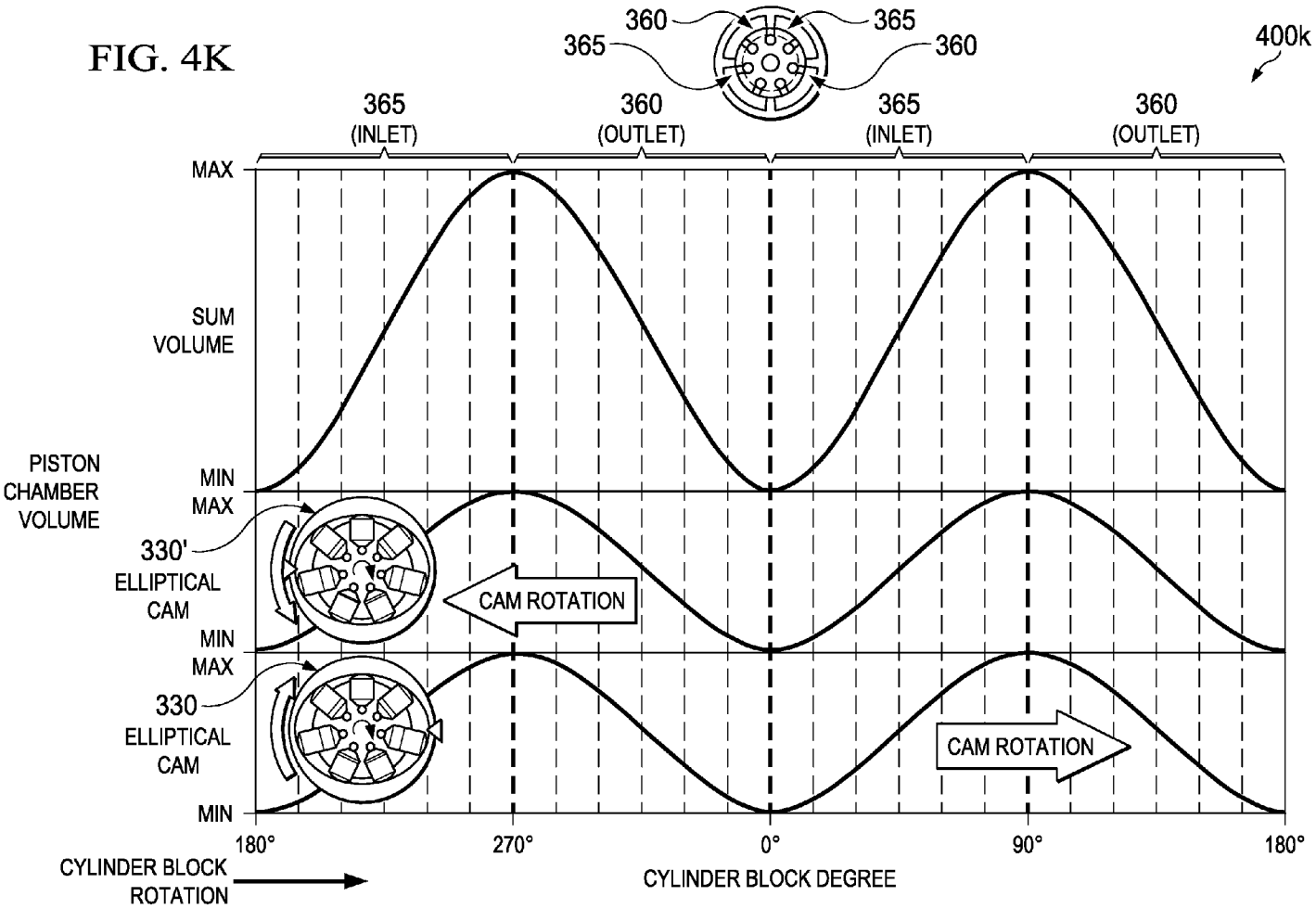

In FIG. 4G, piston chamber volume chart 400*g* shows the delta angle between the BDC positions of two elliptical cams is changed to 105 degrees (15 degrees past 90 degrees). When cams 330 and 330' are at a delta index angle of greater than 90 degrees, the flow direction through radial fluid device 300 is reversed. Port 360 becomes an exhaust, and port 365 becomes an inlet. In this arrangement, as the cylinder block rotates pistons 340 and 340' from zero degrees BCD to 90 degrees top dead center (TDC), fluid enters piston chamber 345 through port 365.

Then as cylinder block 320 rotates from 90 degrees to 180 degrees (the second BDC), fluid exits the piston chamber 345 through port 360. The same complete cycle is repeated a second time as cylinder block 320 rotates from 180 degrees to 360 degrees (back to zero degrees).

FIGS. 4H, 4I, 4J, and 4K progressively depict the effect of increasing the delta index angle between the BDC positions of cams 330 and 330' from 120 degrees, 135 degrees, 150 degrees, and 180 degrees. As shown in piston chamber volume charts 400*h*-400*k*, increasing the delta phase angle results in effective reductions in the sum of maximum sinusoidal cylinder volume to 44%, 66%, 83%, and 100% of maximum. Thus, flow volume in chart 400*k* is equal to flow volume in chart 400*a* but in the opposite direction. As before, each change in delta index angle does not disrupt the relationship between rotary valve timing and the maximum and minimum sinusoidal volume peaks.

In each of the examples shown in FIGS. 4A-4K, drive gears 370 and 370' move cams 330 and 330' to a specific phase angle. In the example of FIGS. 3A-3F, drive gears 370 and 370' are cylindrical spur gears. Teachings of certain embodiments, however, recognize that other types of drive gears may be used in different environments.

Figure 5A:
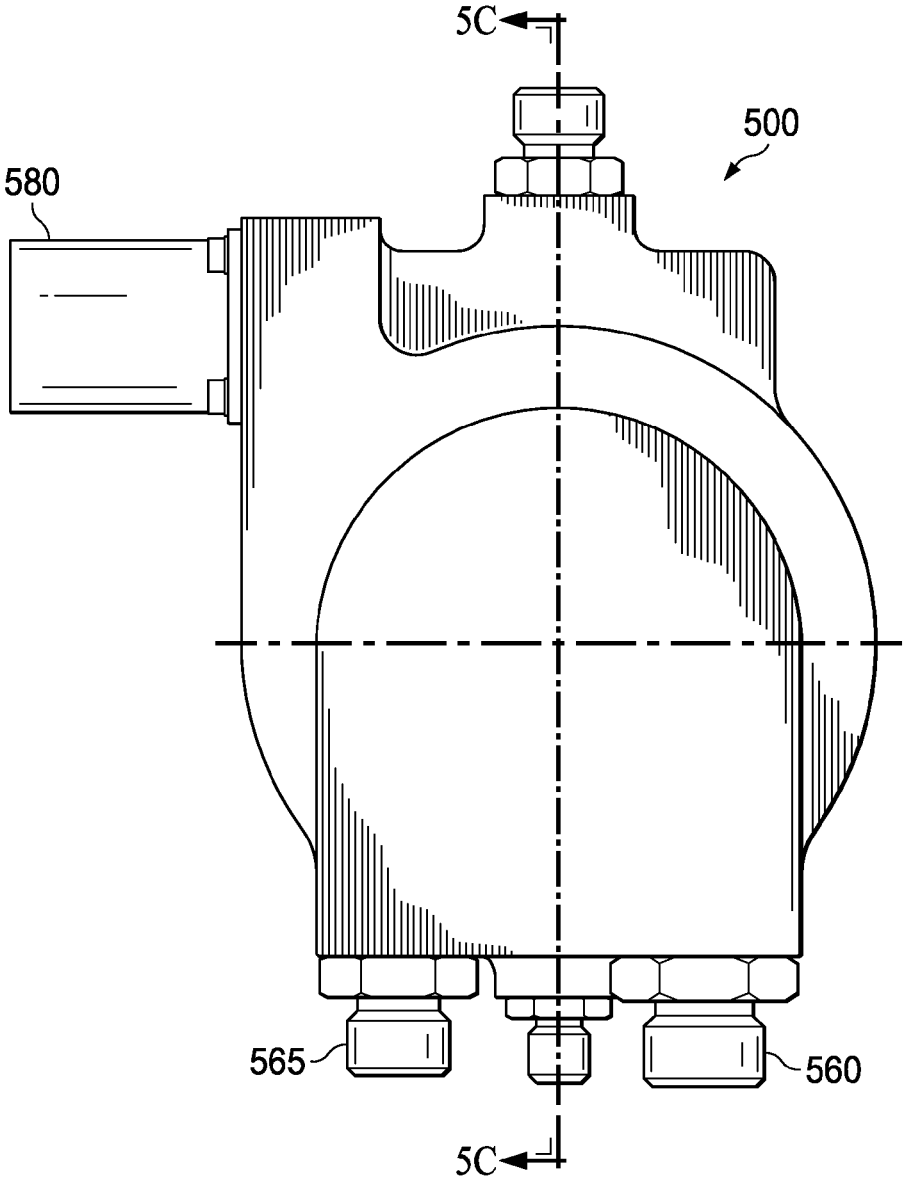
FIGS. 5A-5E show an example alternative embodiment of the radial fluid device of FIG. 3A-3F.
Figure 5B:
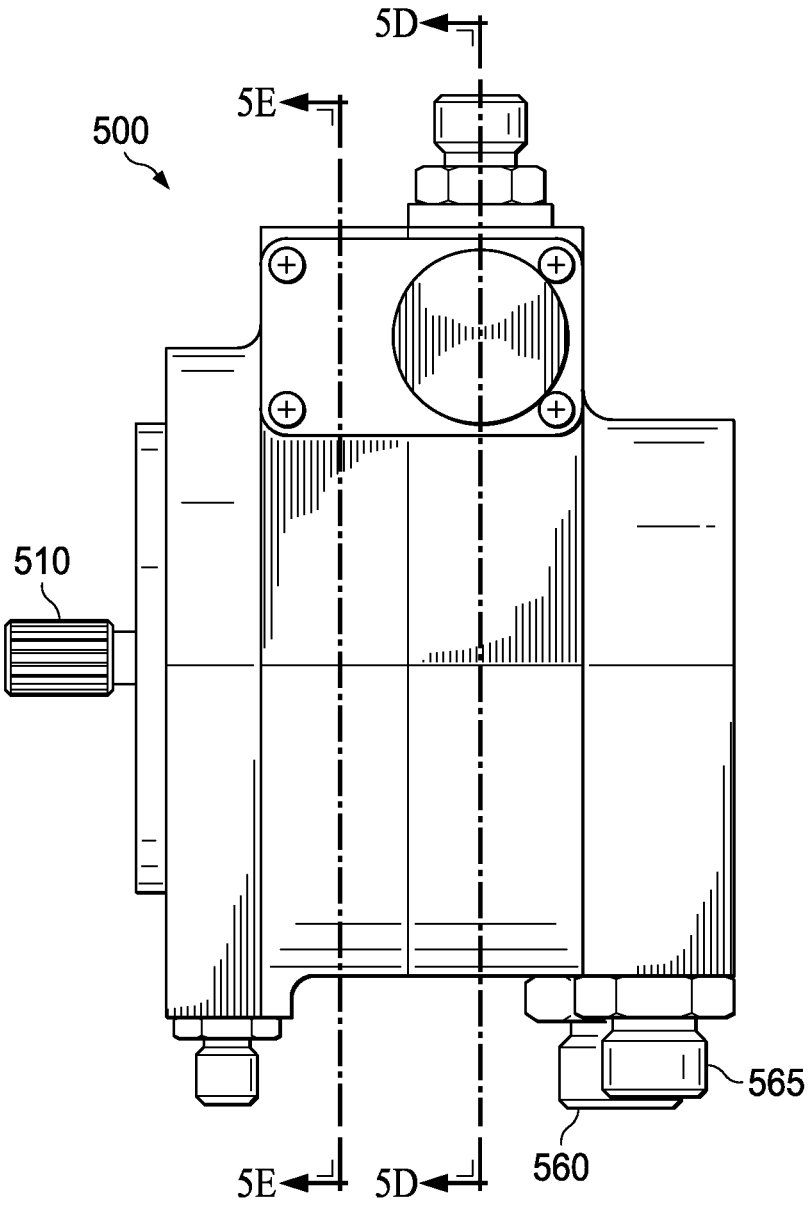
Figure 5C:
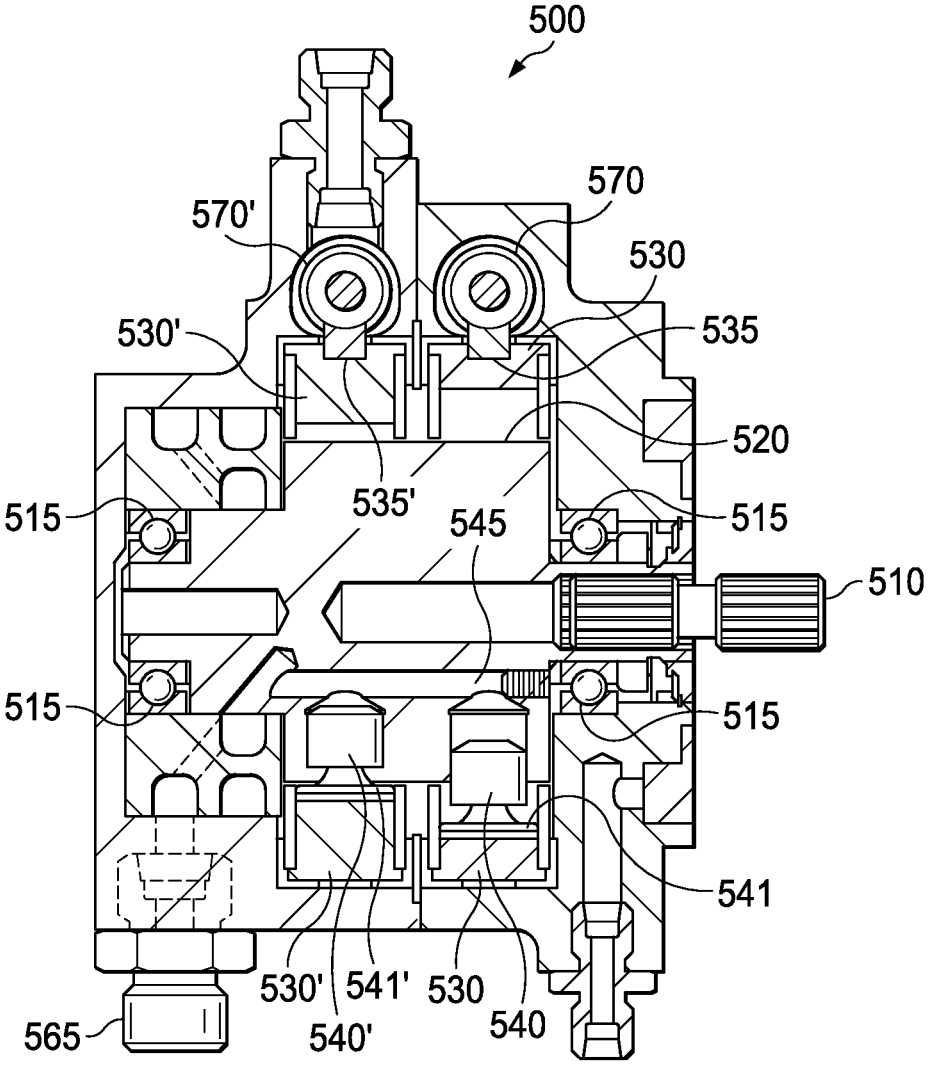
Figure 5D:
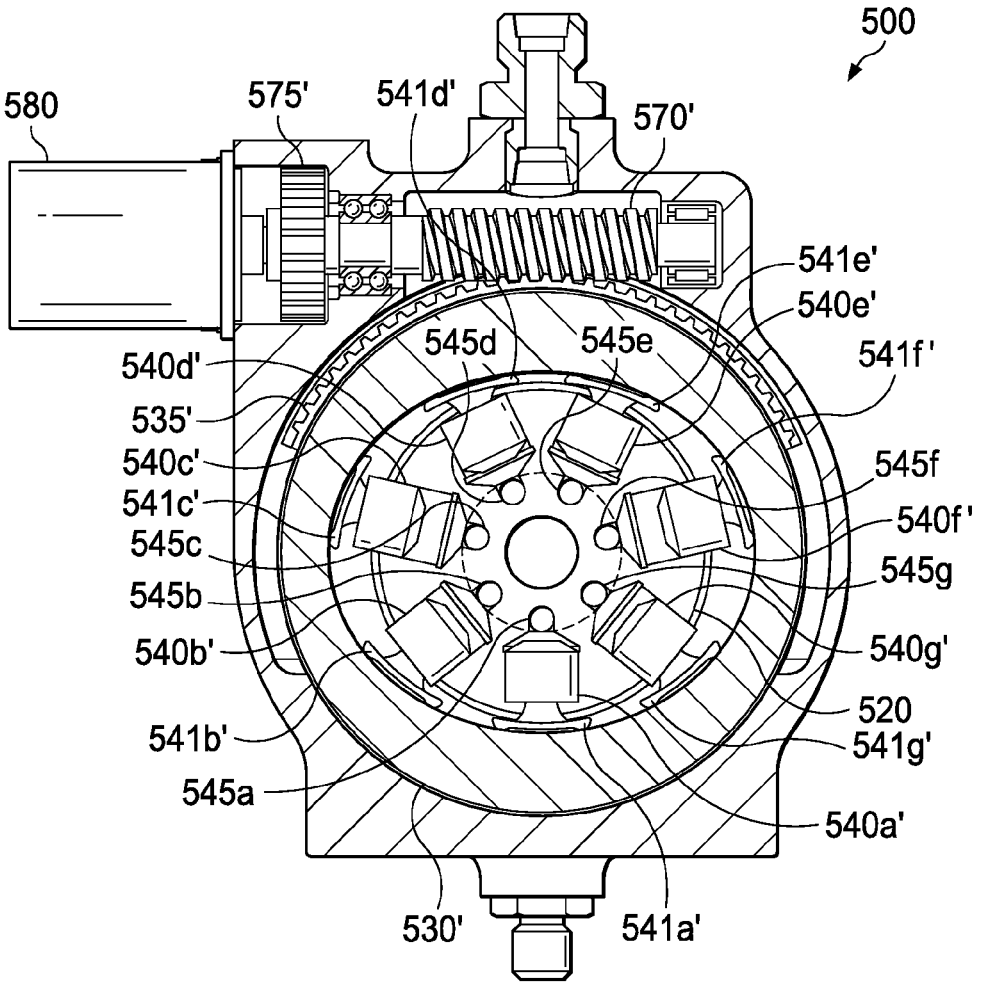
Figure 5E:
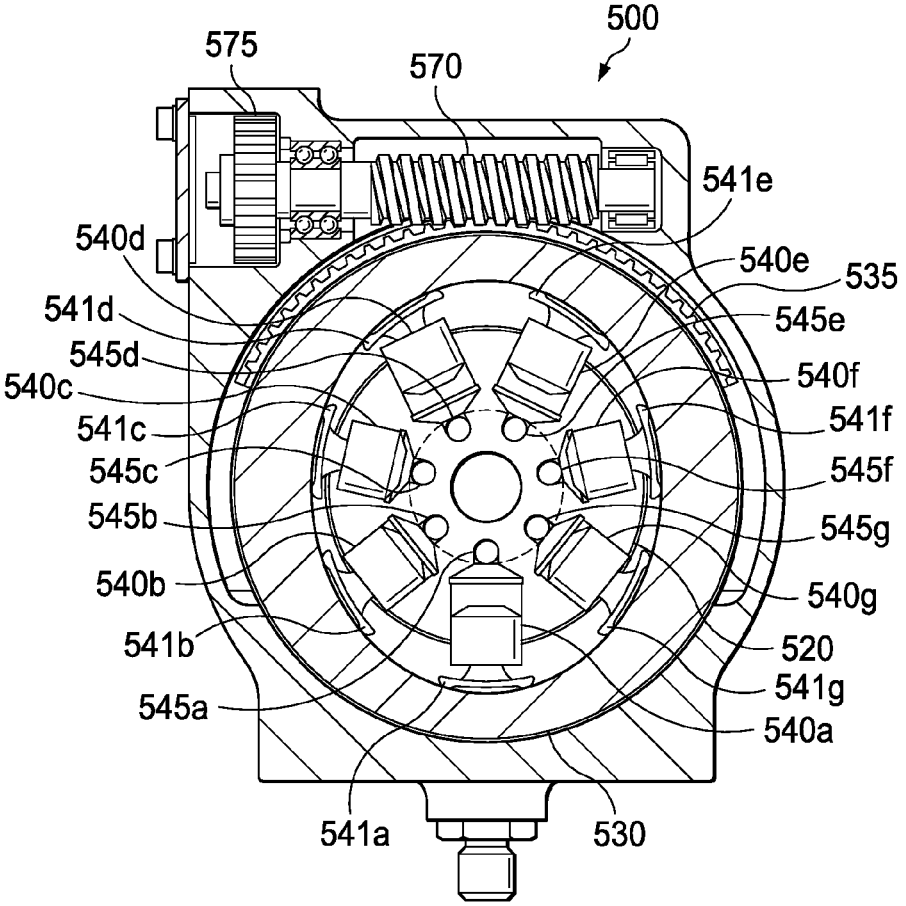

For example, FIGS. 5A-5E show a radial fluid device 500 according to one alternative embodiment. FIG. 5A shows a front view of radial fluid device 500, and FIG. 5B shows a side view of radial fluid device 500. FIG. 5C shows a cross-section view of radial fluid device 500 along the cross-section line indicated in FIG. 5A, and FIGS. 5D and 5E show cross-section views of radial fluid device 500 along the cross-section lines indicated in FIG. 5B. As will be explained in greater detail below, radial fluid device 500 features worm gears 570 and 570' in place of the spur gears 370 and 370' of radial fluid device 300.

Similar to radial fluid device 300, radial fluid device 500 features a shaft 510, bearings 515, a cylinder block 520, cams 530 and 530', pistons 540*a*-540*g*, pistons 540*a*'-540*g*', piston chambers 545*a*-545*g*, shoes 541*a*-541*g*, shoes 541*a*'-541*g*', and ports 560 and 565. In operation, cylinder block 520 rotates within radial fluid device 500, and pistons 540*a*-540*f* and 540*a*'-540*f*' reciprocate within piston chambers 545*a*-545*f* depending on the relative positions of cam gears 535 and 535'.

Radial fluid device 500 also features cam gears 535 and 535', drive gears 570 and 570', reverse rotation gears 575, and cam adjuster 580. Cam gears 535 and 335', drive gears 570 and 570, reverse rotation gears 575, and cam adjuster 580 in combination adjust the position of cams 530 and 530'. Cam gears 535 and 535' are coupled to cams 530 and 530', respectively. Drive gears 570 and 570' interact with the teeth of cam gears 535 and 535'. Reverse drive gears 375 interact with drive gears 570 and/or 570', either directly or indirectly. In particular, reverse drive gears 575 mechanically couples drive gears 370 and 370' together such that rotation in one direction by drive gear 570 results in rotation in the opposite direction by drive gear 570'. Cam adjuster 580 rotates at least one of drive gear 570, drive gear 570', and reverse rotation gear 575 such that drive gear 570 and drive gear 570' rotates cam gears 33 and 535'.

By using worm drive gears 570 and 570' instead of the spur drive gears 370 and 370' of radial fluid device 300, cam adjuster 380 may be moved from the front of radial fluid device 300 to the side of radial fluid device 500, as shown in FIGS. 5A and 5D. Repositioning cam adjustor 580 may allow radial fluid device 500 to be installed in a variety of additional environments.

Figure 6:
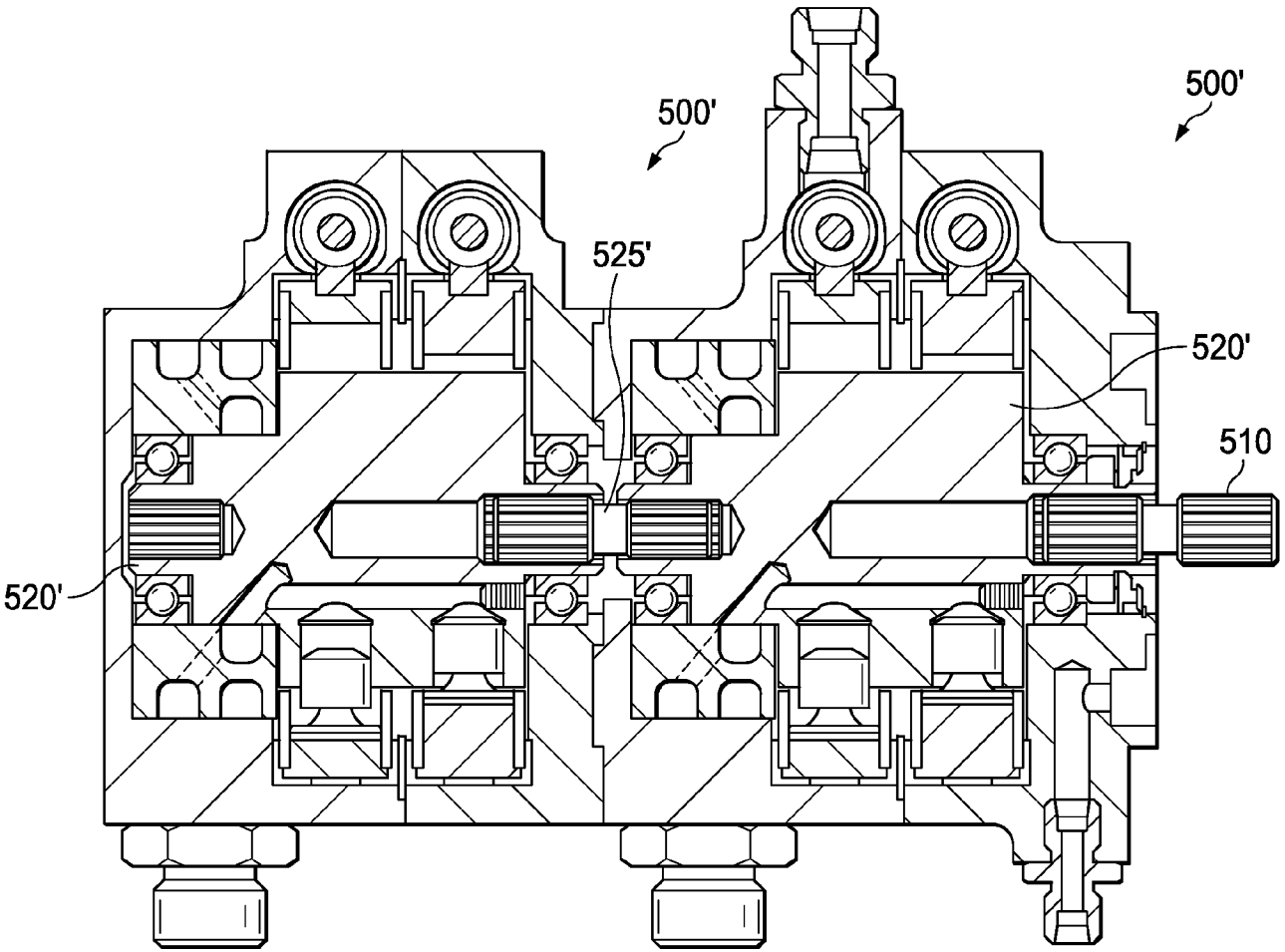
FIG. 6 shows two radial fluid devices of FIGS. 5A-5E coupled together in series.

In addition, repositioning cam adjustor 580 may allow multiple fluid devices 500 to be coupled together. FIG. 6 shows two fluid devices 500' coupled together according to one example embodiment. Fluid devices 500' are similar to radial fluid device 500 except that fluid devices 500' include a second opening in cylinder 520' opposite input shaft 510 for receiving a coupling input shaft 525'. Coupling input shaft 525' may be inserted into the second opening of a first radial fluid device 500' at one end and into the opening for input shaft 510' in a second radial fluid device 500', as shown in FIG. 6. In the example of FIG. 6, fluid devices 500' are coupled together such that input shaft 510 is coaxial with coupling input shaft 525'.

Teachings of certain embodiments recognize that coupling multiple fluid devices together may eliminate the need for an additional gearbox when multiple fluid devices are used. The cams of each fluid device may operate at different phase angles. When used in applications where operating loads reverse direction, one fluid device can vary its effective displacement to act as a motor and regenerate power to a coupled fluid device. For example, in FIG. 6, input shaft 510 may provide power to both fluid devices 500' when they both operate at a zero degree phase angle. If one radial fluid device 500' reverses its flow by changing its phase angle to 180 degrees, then this radial fluid device 500' may help power the other radial fluid device 500'. Allowing one radial fluid device 500' to power another radial fluid device 500' may reduce overall system power requirements.

each of these examples, flow volume may be adjusted by changing the phase angle between adjacent cams. Teachings of certain embodiments recognize that phase angle may be changed during operation to provide a constant flow volume even as system flow demand varies.

Figure 7A:
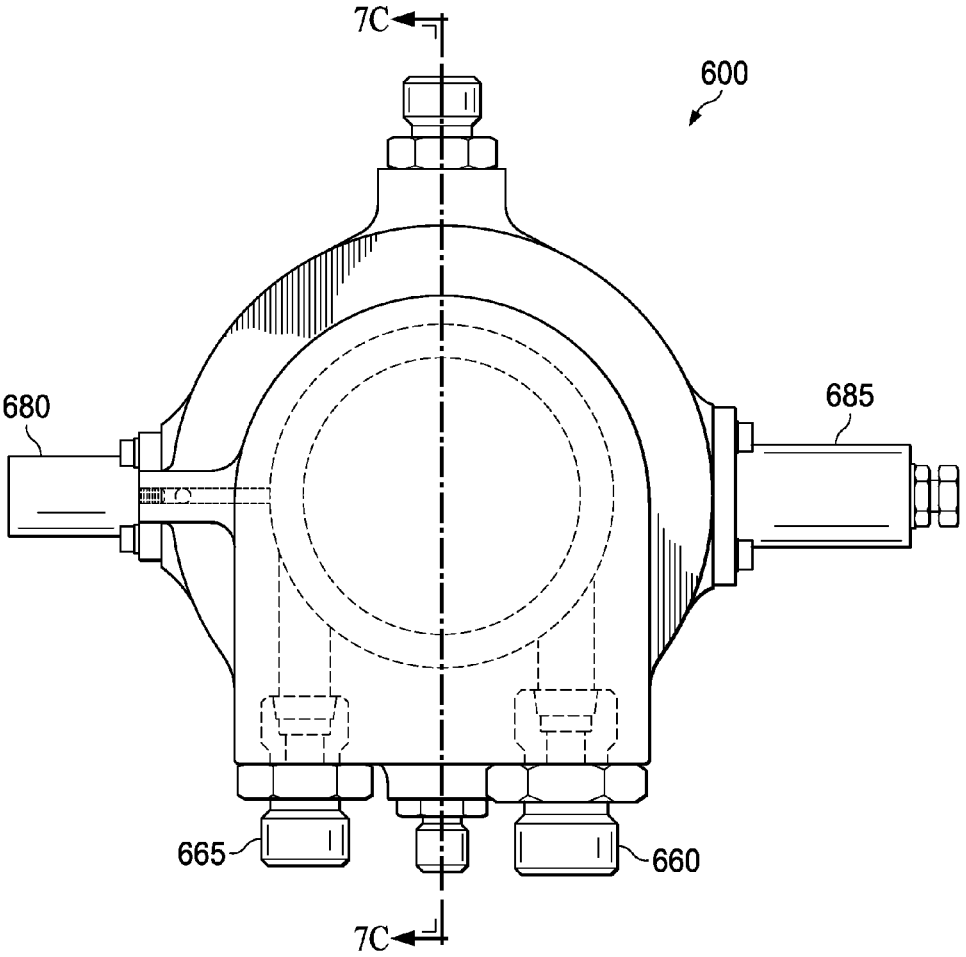
FIGS. 7A-7J show another example alternative embodiment of the radial fluid device of FIG. 3A-3F.
Figure 7B:
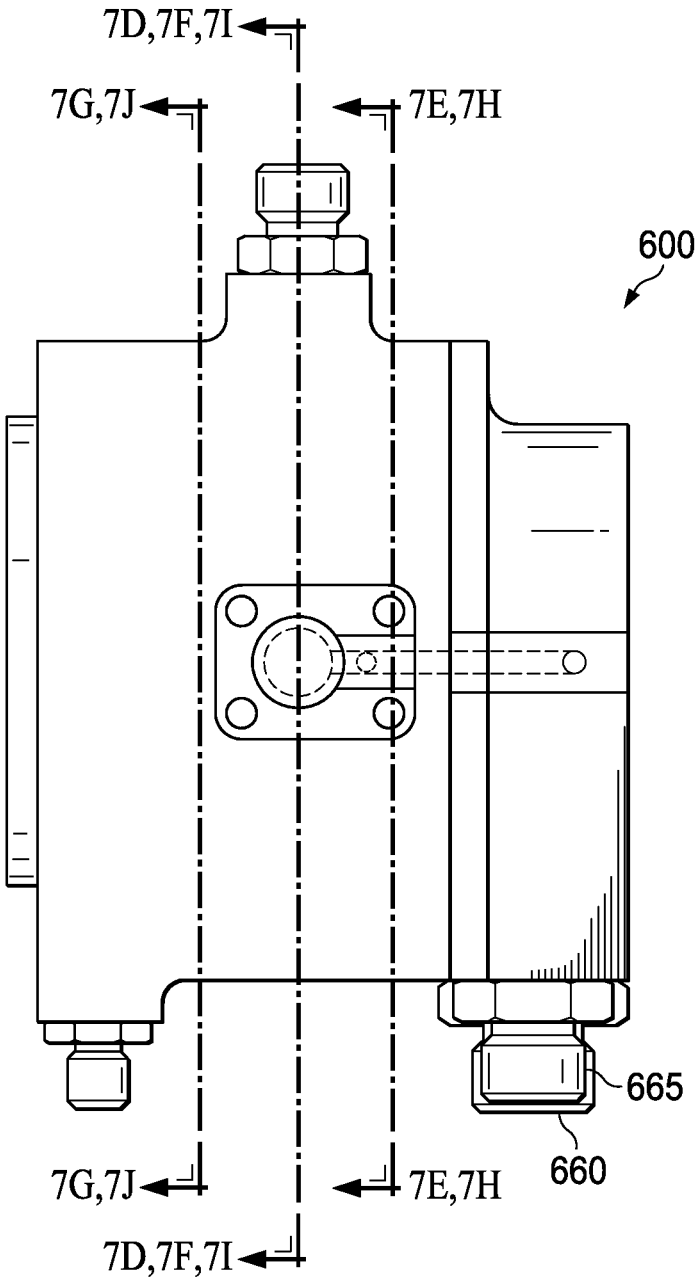
Figure 7C:
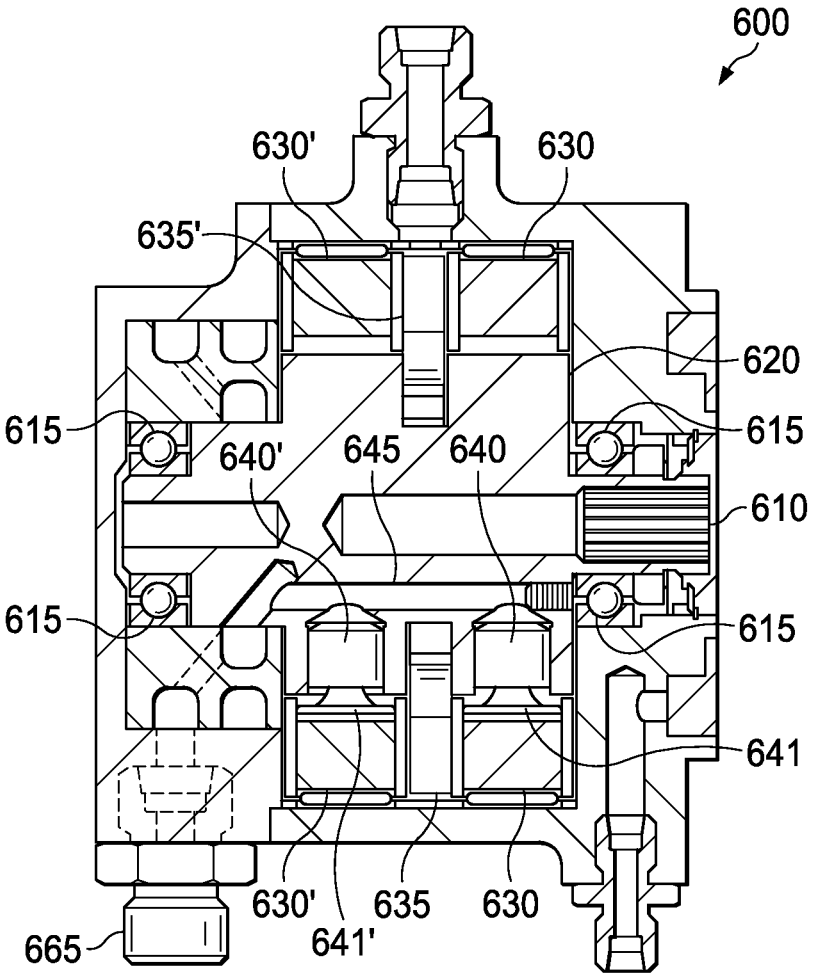
Figure 7D:
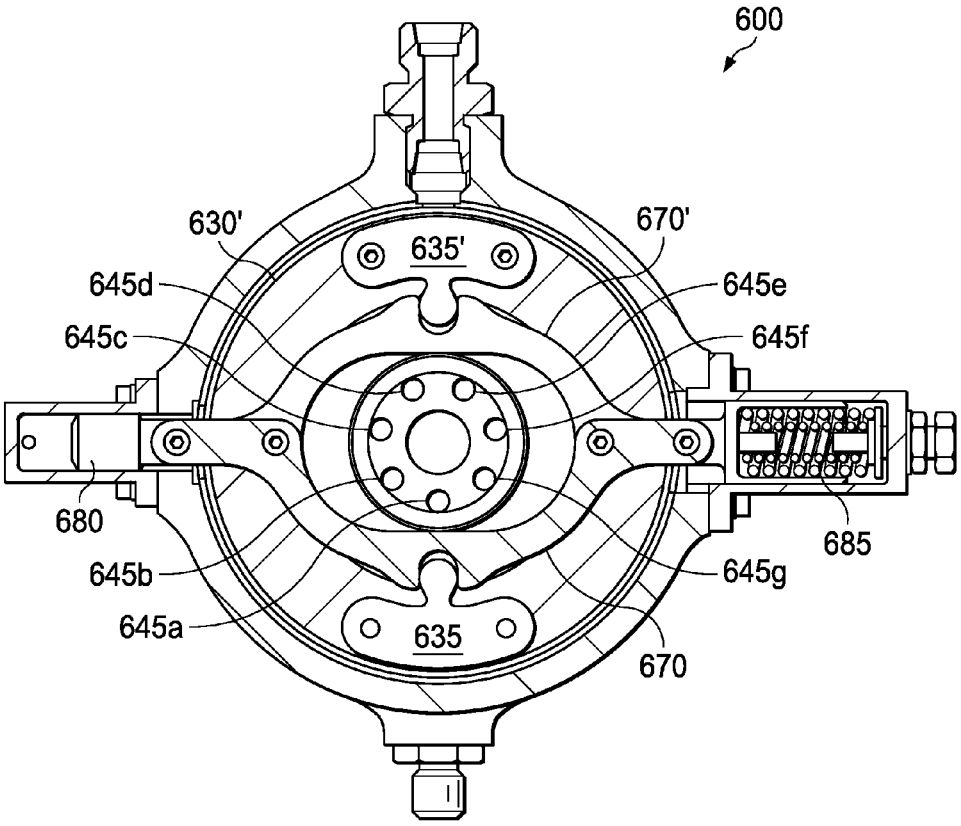
Figure 7G:
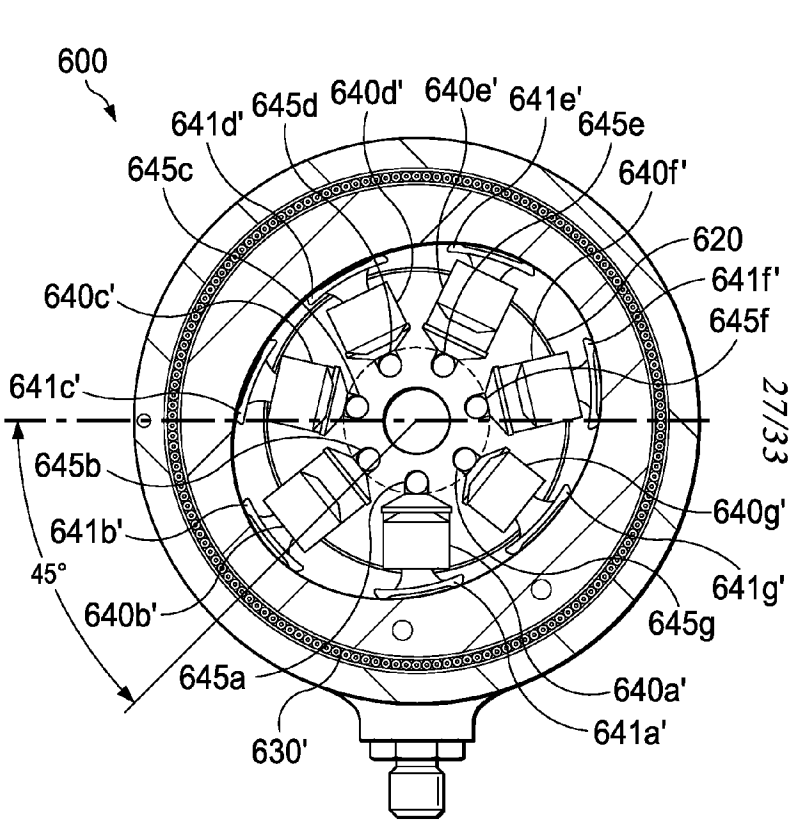
Figure 7E:
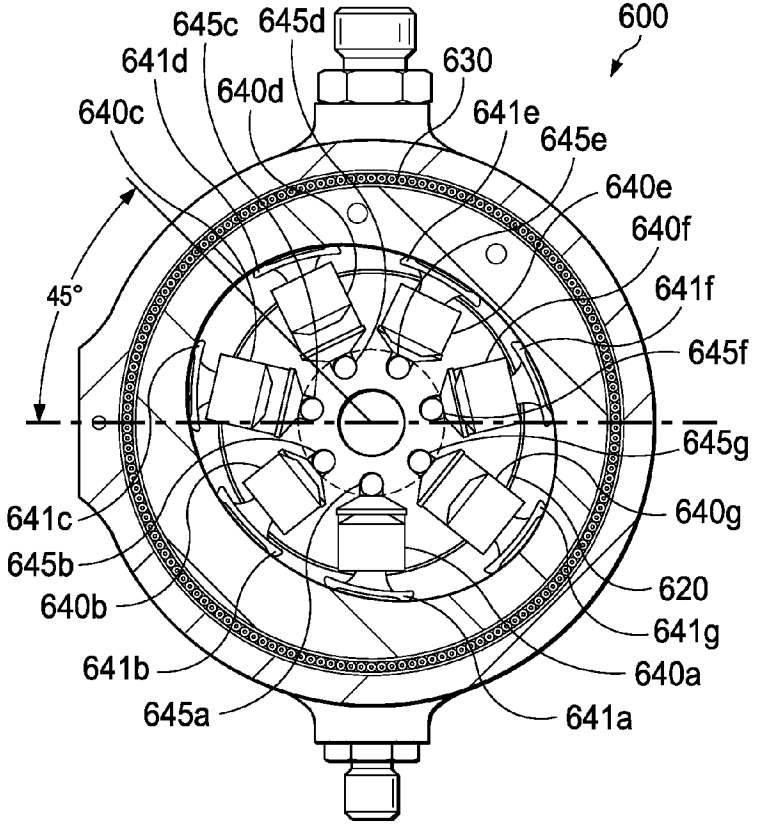
Figure 7F:
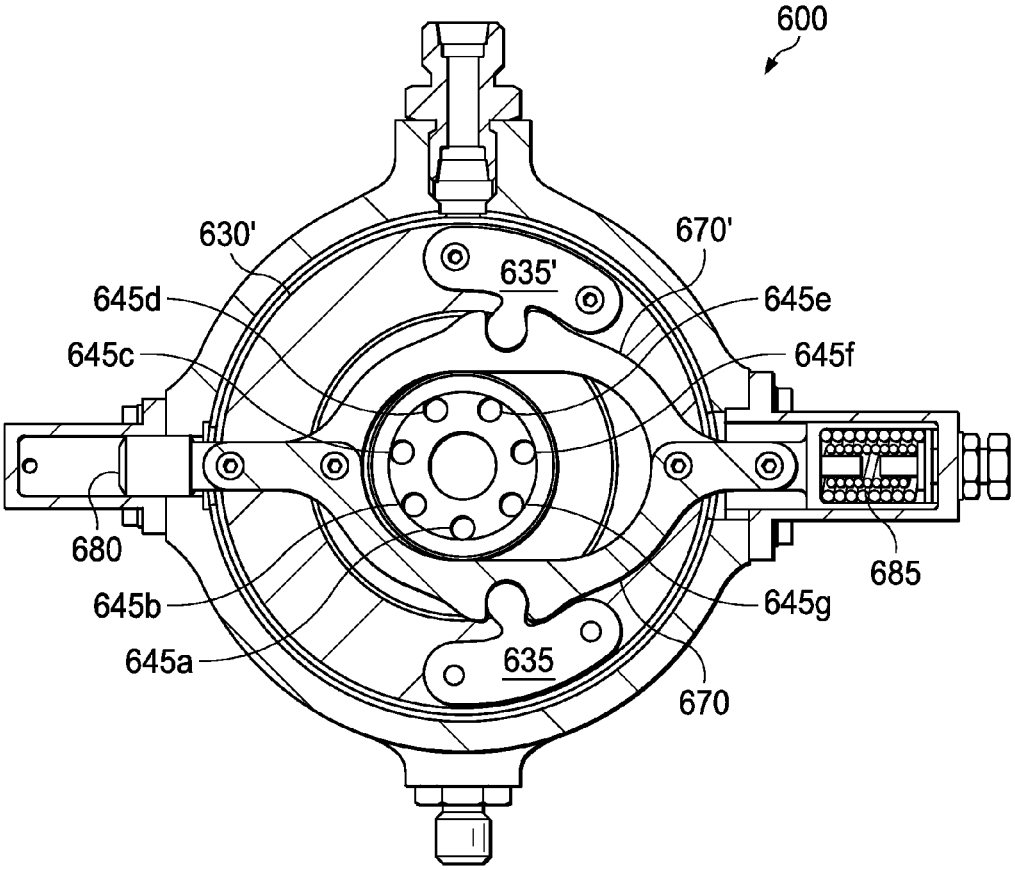
Figure 7J:
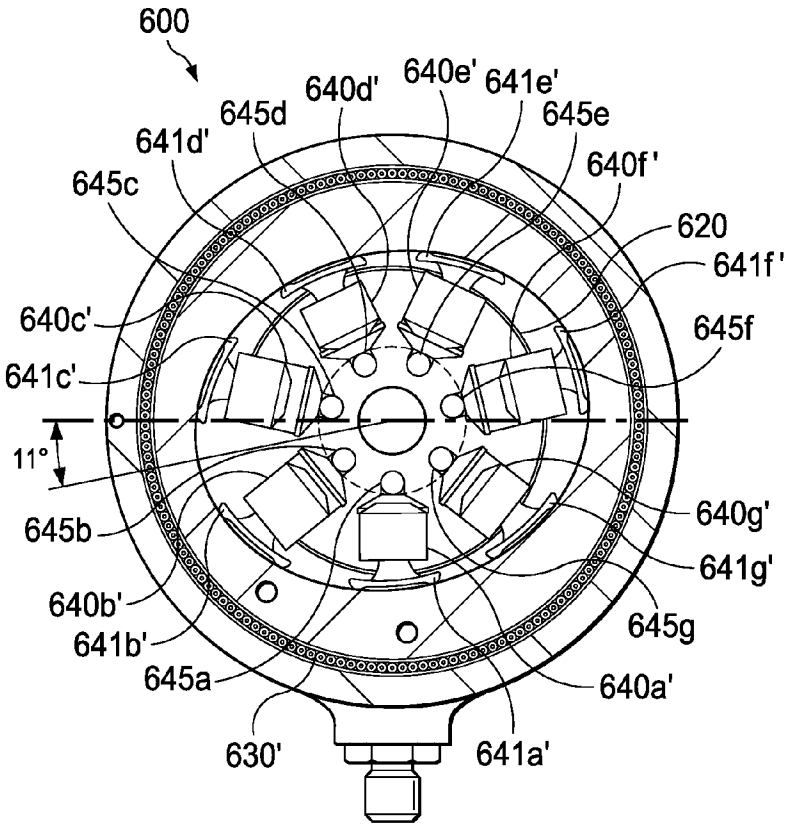
Figure 7H:
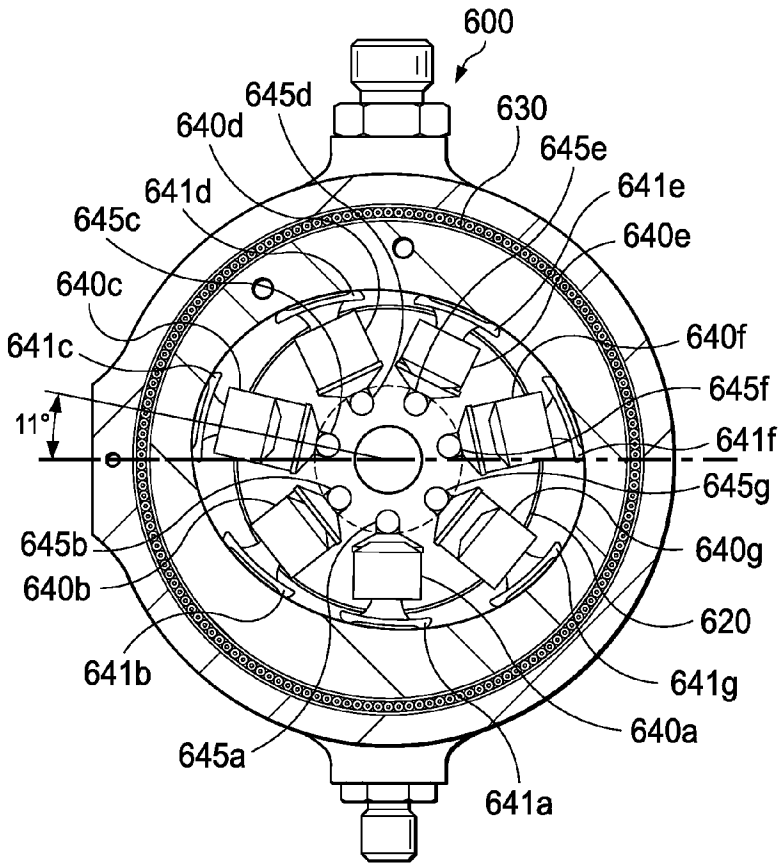
Figure 7I:
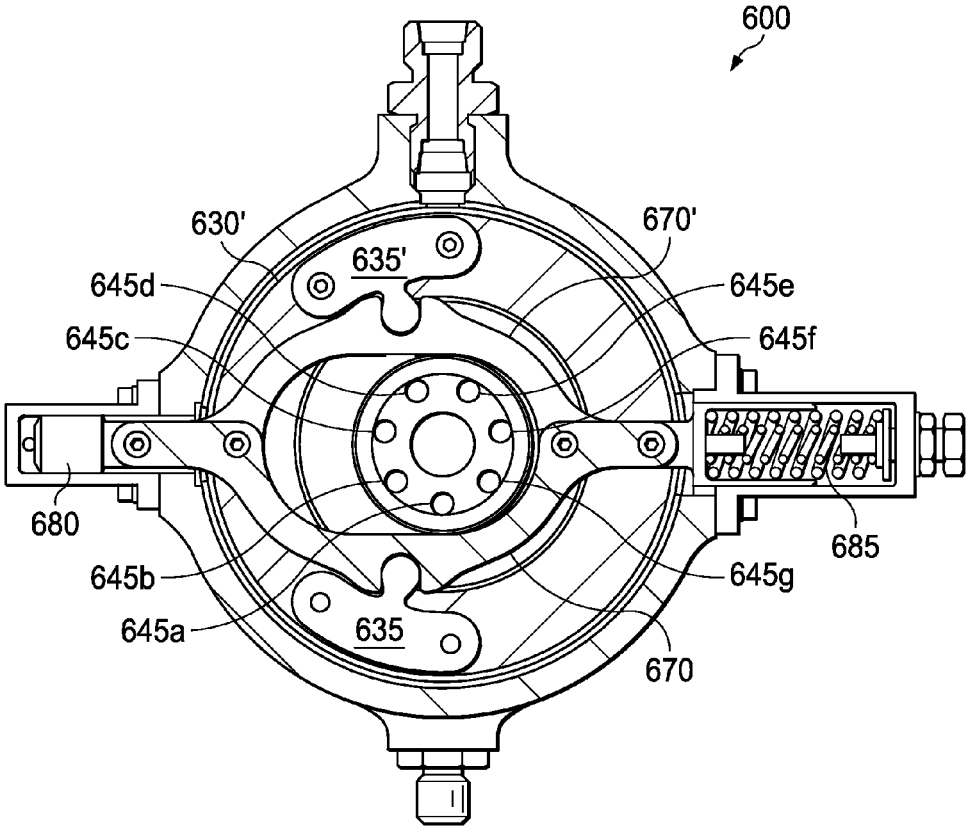

For example, FIGS. 7A-7J show a constant-pressure radial fluid device 600 according to one alternative embodiment. FIG. 7A shows a front view of radial fluid device 600, and FIG. 7B shows a side view of radial fluid device 600. FIG. 7C shows a cross-section view of radial fluid device 600 along the cross-section line indicated in FIG. 7A, and FIG. 7D shows a cross-section view of radial fluid device 600 along the cross-section lines indicated in FIG. 7B. FIGS. 7E-7G show cross-section views of radial fluid device 600 along the cross-section lines indicated in FIG. 7B when radial fluid device 600 is operating at minimum displacement. FIGS. 7H-7J show cross-section views of radial fluid device 600 along the cross-section lines indicated in FIG. 7B when radial fluid device 600 is operating at near maximum displacement. As will be explained in greater detail below, radial fluid device 600 features cam lugs 635 and 635' in place of cam gears 335 and 335', yokes 670 and 670' in place of gears 370 and 370', and pressure compensators 680 and 685 in place of cam adjuster 380 of radial fluid device 300.

Similar to radial fluid devices 300 and 500, radial fluid device 600 features a shaft 610, bearings 615, a cylinder block 620, cams 630 and 630', pistons 640*a*-640*g*, pistons 640*a*'-640*g*', piston chambers 645*a*-645*g*, shoes 641*a*-641*g*, shoes 641*a*;-641*g*', and ports 660 and 665. In operation, cylinder block 620 rotates within radial fluid device 600, and pistons 640*a*-640*f* and 640*a*'-640*f*' reciprocate within piston chambers 645*a*-645*f* depending on the relative positions of cam gears 635 and 635'.

Radial fluid device 600 also features cam lugs 635 and 635', yokes 670 and 670', and pressure compensators 680 and 685. Cam lugs 635 and 635', yokes 670 and 670', and pressure compensators 680 and 685, in combination, adjust the position of cams 630 and 630'. Cam lugs 635 and 635' are coupled to cams 630 and 630', respectively. Yokes 670 and 670' interact with cam lugs 635 and 635'. Pressure compensator 680 is coupled to at least one of yoke 670 and 670', and pressure compensator 685 is coupled to at least one of yoke 670 and 670' opposite pressure compensator 680.

In operation, pressure compensator 680 provides linear movement that pushes or pulls at least one of yokes 670 and 670'. In this example, cams 330 and 330' are supported by roller bearings to minimize friction induced hysteresis effects. Pressure compensator 685 reacts against the linear movement of pressure compensator 680 to balance the yokes 670 and 670'. In the example of FIG. 7D, pressure compensator 680 is a piston, and pressure compensator 685 is a balance spring. Linear movement by pressure compensator 680 causes yokes 670 and 670' to move cam lugs 635 and 635'. Movement of cam lugs 635 and 635' causes rotation of cams 630 and 630'. As explained above, rotating cams 630 and 630' changes the fluid volume flowing through radial fluid device 600.

FIGS. 7E-7G show cross-section views of radial fluid device 600 along the cross-section lines indicated in FIG. 7B when radial fluid device 600 is operating at minimum displacement. In this example, pressure compensator 680 is fully extended, pushing cam lugs 635 and 635' to the right as shown in FIG. 7F. In this example embodiment, fully extending pressure compensator 680 causes cams 630 and 630' to be 90 degrees out of phase. In FIG. 7E, cam 630 is rotated 45 degrees clockwise, and in FIG. 7G, cam 630' is rotated 45 degrees counter-clockwise. As explained above, oriented cams 90 degrees out of phase may result in minimal or no fluid flow through a radial fluid device.

FIGS. 7H-7J show cross-section views of radial fluid device 600 along the cross-section lines indicated in FIG. 7B when radial fluid device 600 is operating at near maximum displacement. In this example, pressure compensator 680 is retracted, pulling cam lugs 635 and 635' to the left as shown in FIG. 71. In this example embodiment, retracted pressure compensator 680 causes cams 630 and 630' to be 22 degrees out of phase. In FIG. 7E, cam 630 is rotated 11 degrees clockwise, and in FIG. 7G, cam 630' is rotated 11 degrees counter-clockwise. In this example, the maximum displacement position is set to 22 degrees in an effort to minimize the yoke displacement required for the kinematic geometry to drive the cam lugs. In some embodiments, however, it may be possible to retract pressure compensator 680 further so that cams 630 and 630' are fully in phase.

Radial fluid device 600, like radial fluid devices 300 and 500, features two sets of pistons, seven radial pistons per set, and two lobes per cam. Teachings of certain embodiments, however, recognize that other radial devices may have any number of piston sets, pistons per sets, and lobes per cam. In addition, embodiments may have other configuration changes as well, such as different cam followers (e.g., sliding, roller, and spherical ball).

Figure 8B:
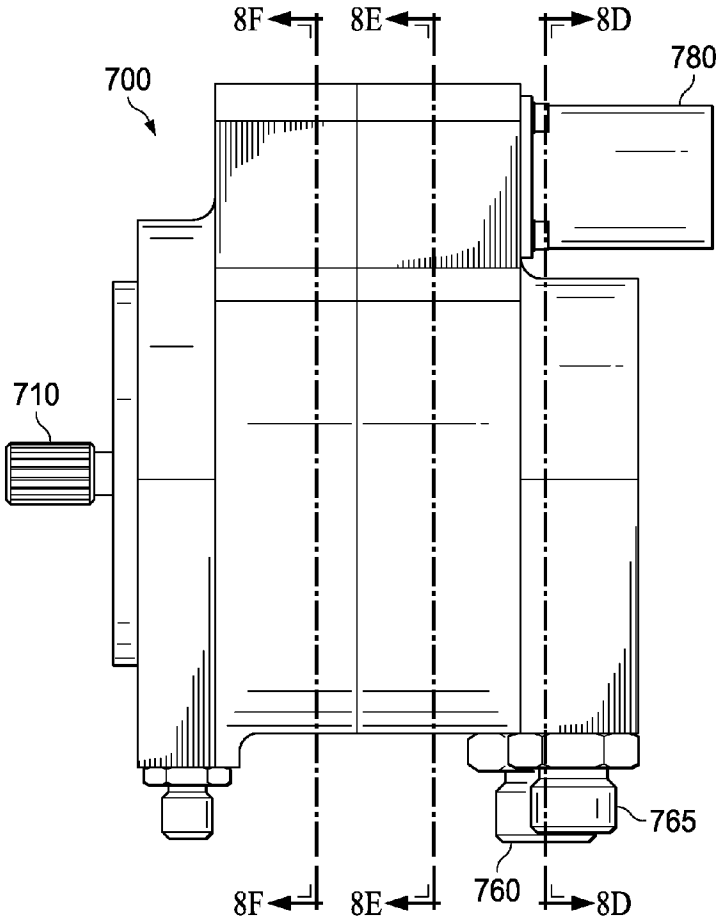
FIGS. 8A-8F show yet another example alternative embodiment of the radial fluid device of FIG. 3A-3F.
Figure 8A:
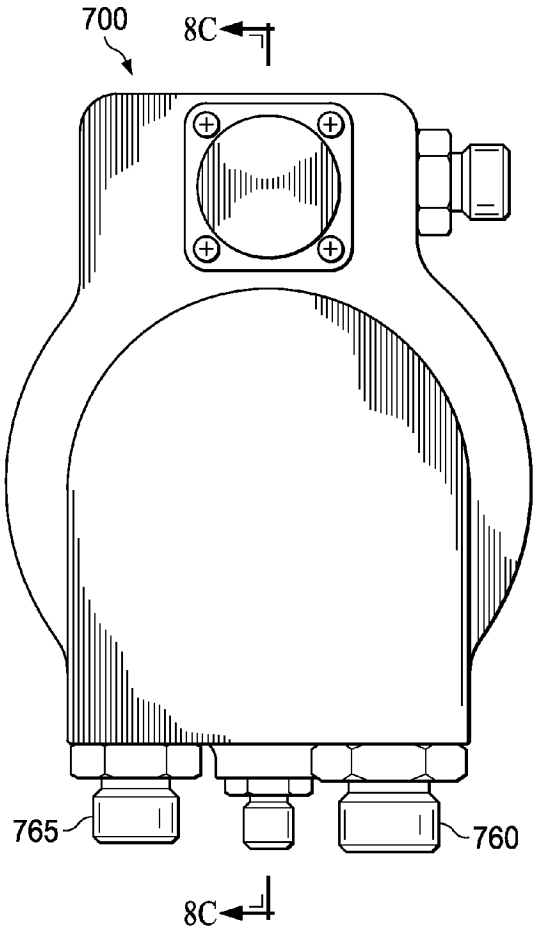
Figure 8D:
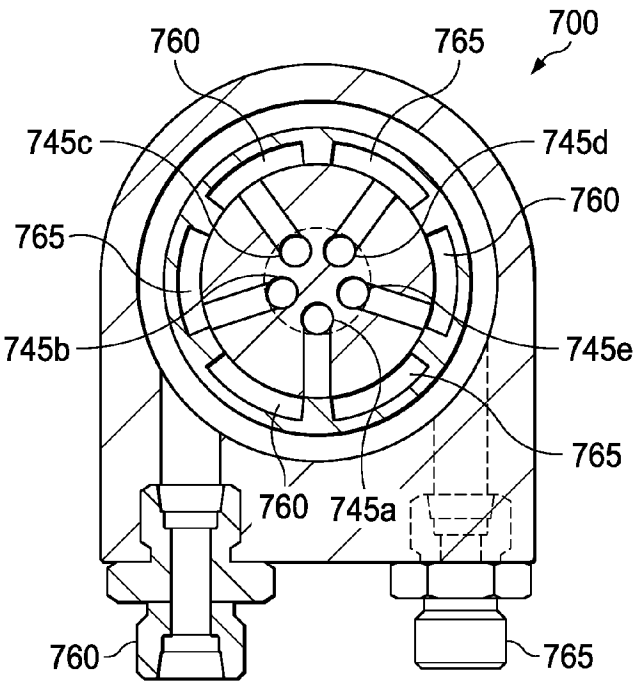
Figure 8C:
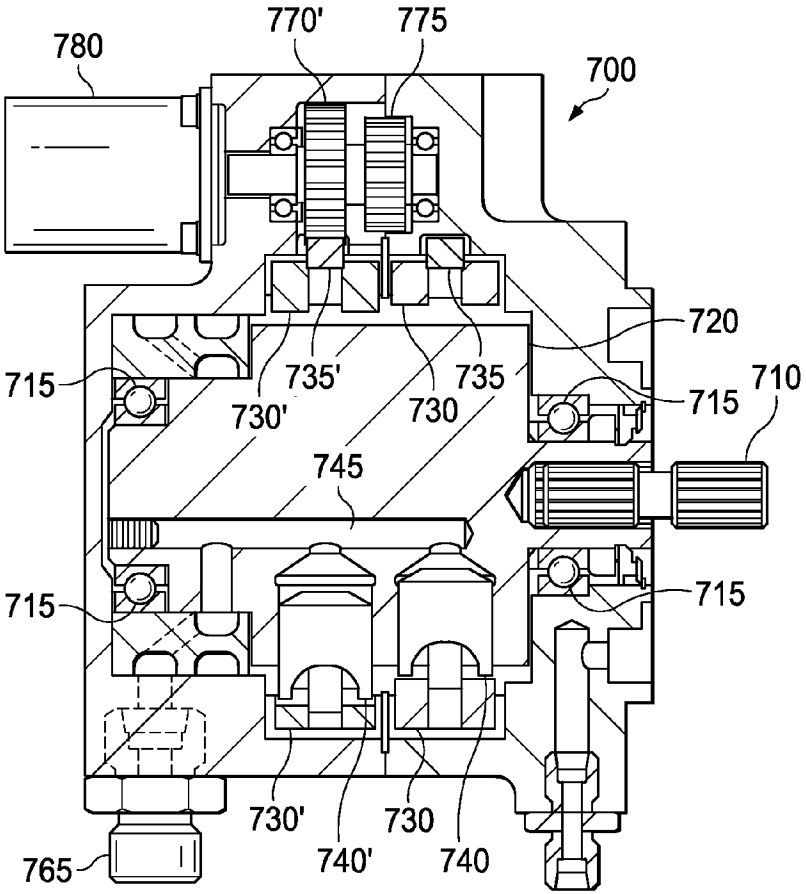
Figure 8F:
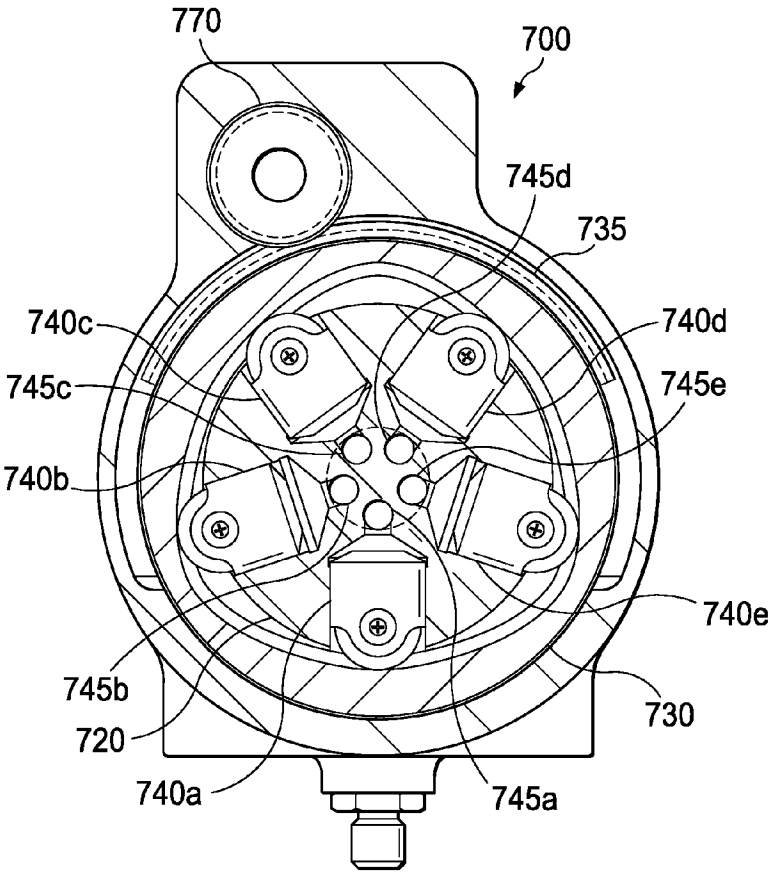
Figure 8E:
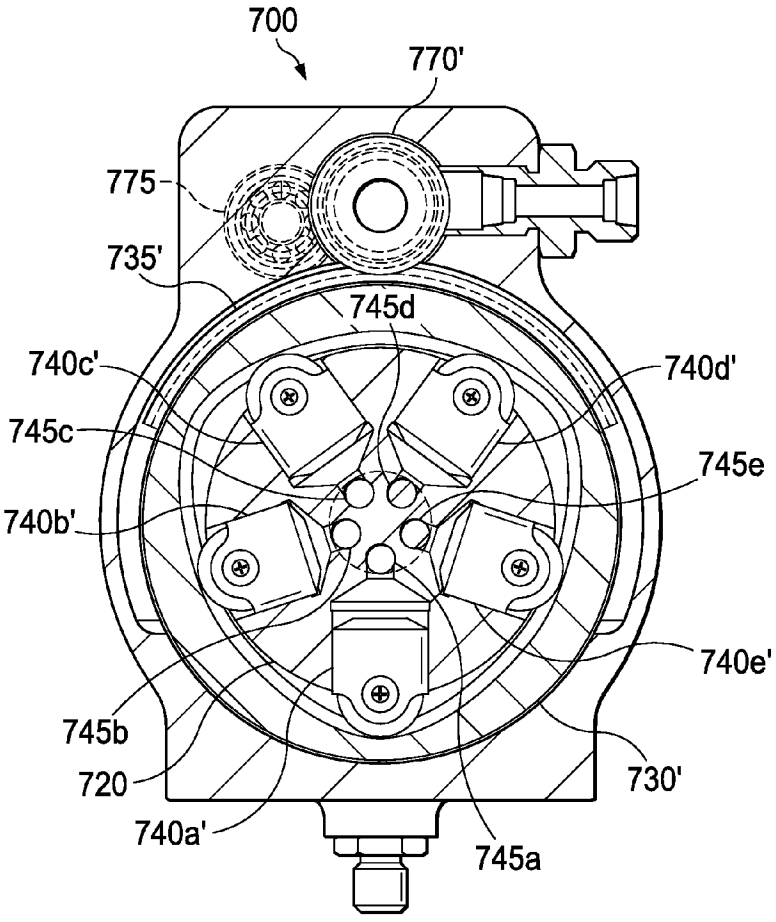

FIGS. 8A-8F show a radial fluid device 700 according to an alternative embodiment. In the example of FIGS. 8A-8F, radial fluid device 700 features tri-lobed cams and five pistons per set. FIG. 8A shows a front view of radial fluid device 700, and FIG. 8B shows a side view of radial fluid device 700. FIG. 8C shows a cross-section view of radial fluid device 700 along the cross-section line indicated in FIG. 8A, and FIGS. 8D, 8E, and 8F show cross-section views of radial fluid device 700 along the cross-section lines indicated in FIG. 8B.

Similar to radial fluid devices 300, 500, and 600, radial fluid device 700 features a shaft 710, bearings 715, a cylinder block 720, cams 730 and 730', pistons 740*a*-740*f*, pistons 740*a*'-740*f*', piston chambers 745*a*-745*f*, and ports 760 and 765. In operation, cylinder block 720 rotates within radial fluid device 700, and pistons 740*a*-740*f* and 740*a*'-740*f*' reciprocate within piston chambers 745*a*-745*f* depending on the relative positions of cam gears 735 and 735'. Unlike radial fluid devices 300, 500, and 600, each piston in radial fluid device 700 completes three sinusoidal strokes per rotation of cylinder block 720.

Modifications, additions, or omissions may be made to the systems and apparatuses described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order.

Although several embodiments have been illustrated and described in detail, it will be recognized that substitutions and alterations are possible without departing from the spirit and scope of the present invention, as defined by the appended claims.

To aid the Patent Office, and any readers of any patent issued on this application in interpreting the claims appended hereto, applicants wish to note that they do not intend any of the appended claims to invoke paragraph 6 of 35 U.S.C. §112 as it exists on the date of filing hereof unless the words "means for" or "step for" are explicitly used in the particular claim.

What is claimed is:

1. A fluid flow system comprising:

a first radial fluid device comprising:

a first cylinder block comprising a first plurality of radially extending cylinders, a second plurality of radially extending cylinders, and a shaft opening;

a first plurality of cylindrical pistons each slidably received within a different one of the first plurality of radially extending cylinders, wherein each cylindrical piston includes:

a radially extending aperture; and a shoe configured to slide along a surface of a first cam that has two or more lobes configured such that the shoe completes two or more sinusoidal strokes per revolution of the cylinder block, the shoe having a rounded forward edge and a rounded trailing edge, the forward edge being the forward most edge of the shoe when the shoe experiences movement, the trailing edge being the rearmost edge of the shoe when the shoe experiences movement, the first cam being disposed about the first plurality of radially extending cylinders;

a second plurality of cylindrical pistons each slidably received within a different one of the second plurality of radially extending cylinders, wherein each cylindrical piston comprises:

a radially extending aperture; and a shoe configured to slide along a surface of a second cam that has two or more lobes configured such that the shoe completes two or more sinusoidal strokes per revolution of the cylinder block, the shoe having a rounded forward edge and a rounded trailing edge, the forward edge being the forward most edge of the shoe when the shoe experiences movement, the trailing edge being the rearmost edge of the shoe when the shoe experiences movement, the second cam being disposed about the second plurality of radially extending cylinders, the second cam movable relative to the first cam;

an input shaft coupled to the first cylinder block at the shaft opening, the input shaft operable to transmit rotational energy to the first cylinder block of the first radial fluid device; and a cam rotation device operable to rotate the first cam of the first radial fluid device in a first direction and the second cam of the first radial fluid device in a second direction opposite the first direction, the cam rotation device of the first radial fluid device comprising:

a first worm gear in contact with the first cam of the first radial fluid device;

a first reverse rotation gear coupled to the first worm gear;

a second worm gear in contact with the second cam of the first radial fluid device; and a second reverse rotation gear coupled to the second worm gear and in contact with the first reverse rotation gear;

a second radial fluid device comprising:

a second cylinder block comprising a third plurality of radially extending cylinders, a fourth plurality of radially extending cylinders, and a shaft opening;

a first plurality of cylindrical pistons each slidably received within a different one of the third plurality of radially extending cylinders, wherein each cylindrical piston includes:

a radially extending aperture; and a shoe configured to slide along a surface of a third cam that has two or more lobes configured such that the shoe completes two or more sinusoidal strokes per revolution of the cylinder block, the shoe having a rounded forward edge and a rounded trailing edge, the forward edge being the forward most edge of the shoe when the shoe experiences movement, the trailing edge being the rearmost edge of the shoe when the shoe experiences movement, the third cam being disposed about the first plurality of radially extending cylinders;

a second plurality of cylindrical pistons each slidably received within a different one of the fourth plurality of radially extending cylinders, wherein each cylindrical piston comprises:

a radially extending aperture; and a shoe configured to slide along a surface of a fourth cam that has two or more lobes configured such that the shoe completes two or more sinusoidal strokes per revolution of the cylinder block the shoe having a rounded forward edge and a rounded trailing edge, the forward edge being the forward most edge of the shoe when the shoe experiences movement, the trailing edge being the rearmost edge of the shoe when the shoe experiences movement, the fourth cam being disposed about the second plurality of radially extending cylinders, the fourth cam movable relative to the third cam; and a coupling device in mechanical communication with the shaft opening of the second radial fluid device and the first cylinder block of the first radial fluid device opposite the shaft opening of the first radial fluid device, the coupling device operable to transmit rotational energy from the first cylinder block of the first radial fluid device to the second cylinder block of the second radial fluid device.

2. The fluid flow system of claim 1, wherein the input shaft and the coupling device are coaxial.

3. The fluid flow system of claim 1, wherein:

the first cylinder block of the first radial fluid device further comprises a second shaft opening opposite the shaft opening; and the coupling device is a coupling shaft coupled to the first cylinder block of the first radial fluid device at the second shaft opening and coupled to the second cylinder block of the second radial fluid device at the shaft opening.

4. The fluid flow system of claim 1, wherein rotating the first cam of the first radial fluid device changes when the first plurality of cylindrical pistons of the first radial fluid device begins its strokes.

5. The fluid flow system of claim 1, wherein movement of the first and second cams of the first radial fluid device is independently controllable from movement of the first and second cams of the second radial fluid device.

6. The fluid flow system of claim 1, wherein:

moving the first cam of the first radial fluid device changes a volume rate of fluid flowing through the first radial fluid device; and moving the first cam of the second radial fluid device changes a volume rate of fluid flowing through the second radial fluid device.

7. The fluid flow system of claim 6, wherein the volume rate of fluid flowing through the first radial fluid device is different from the volume rate of fluid flowing through the second radial fluid device.

8. The fluid flow system of claim 1, wherein:

the first radial fluid device comprises a housing with a first fluid port and a second fluid port, wherein each cylinder has a passageway which selectively communicates with the first fluid port and the second fluid port as the first cylinder block rotates; and the second radial fluid device comprises a housing with a first fluid port and a second fluid port, wherein each cylinder has a passageway which selectively communicates with the first fluid port and the second fluid port as the second cylinder block rotates.

9. The fluid flow system of claim 8, wherein:

the first fluid port of the first radial fluid device and the first fluid port of the second radial fluid device are inlets; and the second fluid port of the first radial fluid device and the second fluid port of the second radial fluid device are exhausts.

10. The fluid flow system of claim 9, wherein moving the second cam of the first radial fluid device relative to the first cam of the first radial fluid device is operable to convert the first fluid port of the first radial fluid device from an inlet to an exhaust and convert the second fluid port of the first radial fluid device from an exhaust to an inlet.

11. The fluid flow system of claim 1, wherein the radially extending cylinders of the first radial fluid device are not in fluid communication with the radially extending cylinders of the second radial fluid device.

12. The fluid flow system of claim 1, wherein the first cylinder block of the first radial fluid device has a different number of cylinders than the second cylinder block of the second radial fluid device.

13. The fluid flow system of claim 1, the first radial fluid device further comprising a cam rotation device operable to rotate the first cam of the first radial fluid device in a first direction and the second cam of the first radial fluid device in a second direction opposite the first direction.

14. A radial fluid device comprising:

a first cylinder block comprising a first plurality of radially extending cylinders, a second plurality of radially extending cylinders;

a first plurality of cylindrical pistons each slidably received within a different one of the first plurality of radially extending cylinders, wherein each cylindrical piston includes:

a radially extending aperture; and shoe configured to slide along a surface of a first cam that has two or more lobes configured such that the shoe completes two or more sinusoidal strokes per revolution of the cylinder block, the shoe having a rounded forward edge and a rounded trailing edge, the forward edge being the forward most edge of the shoe when the shoe experiences movement, the trailing edge being the rearmost edge of the shoe when the shoe experiences movement, the first cam being disposed about the first plurality of radially extending cylinders;

a second plurality of cylindrical pistons each slidably received within a different one of the second plurality of radially extending cylinders, wherein each cylindrical piston comprises:

a radially extending aperture; and a shoe configured to slide along a surface of a second cam that has two or more lobes configured such that the shoe completes two or more sinusoidal strokes per revolution of the cylinder block, the shoe having a rounded forward edge and a rounded trailing edge, the forward edge being the forward most edge of the shoe when the shoe experiences movement, the trailing edge being the rearmost edge of the shoe when the shoe experiences movement, the second cam being disposed about the second plurality of radially extending cylinders, the second cam movable relative to the first cam;

a coupling device in mechanical communication with the first cylinder block and a second cylinder block of a second radial fluid device; and a cam rotation device operable to rotate the first cam in a first direction and the second cam in a second direction opposite the first direction, the cam rotation device comprising:

a first worm gear in contact with the first cam;

a first reverse rotation gear coupled to the first worm gear;

a second worm gear in contact with the second cam; and a second reverse rotation gear coupled to the second worm gear and in contact with the first reverse rotation gear.

15. The radial fluid device of claim 14, the second cylinder block further comprising a shaft opening, the radial fluid device further comprising an input shaft coupled to the second cylinder block at the shaft opening, the input shaft operable to transmit rotational energy to the second cylinder block of the radial fluid device.

16. The radial fluid device of claim 15, wherein the input shaft and the coupling device are coaxial.

17. The radial fluid device of claim 15, wherein:

the second cylinder block further comprises a second shaft opening opposite the shaft opening.

18. The radial fluid device of claim 17, wherein:

the coupling device is a coupling shaft operable to couple to the first cylinder block at the second shaft opening and operable to couple to the second cylinder block of the second radial fluid device.

19. A fluid flow system comprising:

a first radial fluid device comprising:

a first cylinder block comprising a first plurality of radially extending cylinders, a second plurality of radially extending cylinders, and a shaft opening;

a first plurality of cylindrical pistons each slidably received within a different one of the first plurality of radially extending cylinders, wherein each cylindrical piston includes:

a radially extending aperture; and a shoe configured to slide along a surface of a first cam that has two or more lobes configured such that the shoe completes two or more sinusoidal strokes per revolution of the cylinder block, the shoe having a rounded forward edge and a rounded trailing edge, the forward edge being the forward most edge of the shoe when the shoe experiences movement, the trailing edge being the rearmost edge of the shoe when the shoe experiences movement, the first cam being disposed about the first plurality of radially extending cylinders;

a second plurality of cylindrical pistons each slidably received within a different one of the second plurality of radially extending cylinders, wherein each cylindrical piston comprises:

a radially extending aperture; and a shoe configured to slide along a surface of a second cam that has two or more lobes configured such that the shoe completes two or more sinusoidal strokes per revolution of the cylinder block, the shoe having a rounded forward edge and a rounded trailing edge, the forward edge being the forward most edge of the shoe when the shoe experiences movement, the trailing edge being the rearmost edge of the shoe when the shoe experiences movement, the second cam being disposed about the second plurality of radially extending cylinders, the second cam movable relative to the first cam;

an input shaft coupled to the first cylinder block at the shaft opening, the input shaft operable to transmit rotational energy to the first cylinder block of the first radial fluid device;

a second radial fluid device comprising:

a second cylinder block comprising a third plurality of radially extending cylinders, a fourth plurality of radially extending cylinders, and a shaft opening;

a first plurality of cylindrical pistons each slidably received within a different one of the third plurality of radially extending cylinders, wherein each cylindrical piston includes:

a radially extending aperture; and a shoe configured to slide along a surface of a third cam that has two or more lobes configured such that the shoe completes two or more sinusoidal strokes per revolution of the cylinder block, the shoe having a rounded forward edge and a rounded trailing edge, the forward edge being the forward most edge of the shoe when the shoe experiences movement, the trailing edge being the rearmost edge of the shoe when the shoe experiences movement, the third cam being disposed about the first plurality of radially extending cylinders;

a second plurality of cylindrical pistons each slidably received within a different one of the fourth plurality of radially extending cylinders, wherein each cylindrical piston comprises:

a radially extending aperture; and a shoe configured to slide along a surface of a fourth cam that has two or more lobes configured such that the shoe completes two or more sinusoidal strokes per revolution of the cylinder block the shoe having a rounded forward edge and a rounded trailing edge, the forward edge being the forward most edge of the shoe when the shoe experiences movement, the trailing edge being the rearmost edge of the shoe when the shoe experiences movement, the fourth cam being disposed about the second plurality of radially extending cylinders, the fourth cam movable relative to the third cam; and a coupling device in mechanical communication with the shaft opening of the second radial fluid device and the first cylinder block of the first radial fluid device opposite the shaft opening of the first radial fluid device, the coupling device operable to transmit rotational energy from the first cylinder block of the first radial fluid device to the second cylinder block of the second radial fluid device;

wherein the first cam of the first radial fluid device has a different number of lobes than the first cam of the second radial fluid device.

20. The fluid flow system of claim 19, wherein the input shaft and the coupling device are coaxial.

21. The fluid flow system of claim 19, wherein:

the first cylinder block of the first radial fluid device further comprises a second shaft opening opposite the shaft opening; and the coupling device is a coupling shaft coupled to the first cylinder block of the first radial fluid device at the second shaft opening and coupled to the second cylinder block of the second radial fluid device at the shaft opening.

* * * * *